US007344057B2

(12) United States Patent
Dion et al.

(10) Patent No.: US 7,344,057 B2
(45) Date of Patent: Mar. 18, 2008

(54) NAILER WITH ADJUSTABLE GUIDE MEMBER

(75) Inventors: Marc Dion, Saint-Augustin-de-Desmaures (CA); David Lavoie, Charlesbourg (CA); Jacques Maltais, Beauport (CA)

(73) Assignee: Laboratoire Primatech Inc., Quebec, Quebec (CA)

( * ) Notice: Subject to any disclaimer, the term of this patent is extended or adjusted under 35 U.S.C. 154(b) by 50 days.

(21) Appl. No.: 11/415,227

(22) Filed: May 2, 2006

(65) Prior Publication Data

US 2007/0257081 A1 Nov. 8, 2007

(51) Int. Cl.
*B25C 7/00* (2006.01)

(52) U.S. Cl. ..... 227/8; 227/140; 227/148

(58) Field of Classification Search ..... 227/8, 227/148, 151, 140, 119, 147, 130
See application file for complete search history.

(56) References Cited

U.S. PATENT DOCUMENTS 1,393,991 A * 10/1921 Dodenhof ..... 30/486
3,281,046 A * 10/1966 Boulay ..... 227/115
3,360,176 A * 12/1967 Gehl et al. ..... 227/148
3,542,273 A * 11/1970 Hedrick ..... 227/130
4,196,833 A * 4/1980 Haytayan ..... 227/8
4,332,203 A * 6/1982 Flowers ..... 105/422
4,523,706 A * 6/1985 Haley ..... 227/7
4,603,479 A * 8/1986 Bergler ..... 30/475
5,125,552 A * 6/1992 Medwed ..... 227/156
5,180,091 A * 1/1993 Ota ..... 227/8
5,868,183 A * 2/1999 Kozyrski et al. ..... 144/136.1
6,095,392 A * 8/2000 Batts et al. ..... 227/8
6,155,472 A * 12/2000 Deziel ..... 227/8
6,843,402 B2 * 1/2005 Sims et al. ..... 227/148
7,025,242 B1 * 4/2006 Schnell ..... 227/120
7,051,914 B2 * 5/2006 Herelier ..... 227/110
7,059,507 B2 * 6/2006 Almeras et al. ..... 227/8

* cited by examiner

*Primary Examiner*—Scott A. Smith
(74) *Attorney, Agent, or Firm*—Francois Martineau

(57) ABSTRACT

The nailer comprises a main body, an elongated nail ejection channel in the main body for receiving a nail to be ejected and including a nail outlet leading out of the main body, and a plunger carried within and movable along the nail ejection channel. The nailer also includes an actuator capable of moving the plunger along an ejection axis in the nail ejection channel for selectively ejecting the nail out through the nail outlet. A first guide member is carried by and movable relative to the main body, for engaging a first reference surface outboard of the nailer, and a first adjuster mechanism capable of adjusting the position of the first guide member relative to the main body is also provided. The position of the nail ejection channel can be adjusted relative to the first reference surface with the first adjuster mechanism when the nailer engages the first reference surface with the first guide member.

23 Claims, 16 Drawing Sheets

NAILER WITH ADJUSTABLE GUIDE MEMBER

FIELD OF THE INVENTION

The present invention relates to nailers, and more particularly to a nailer with one or more adjustable guide members allowing the position of the nailer's nail ejection channel to be adjusted relative to one or more reference surfaces located outboard of the nailer when the nailer engages the reference surfaces with corresponding guide members.

BACKGROUND OF THE INVENTION

Nailers are used to drive nails through different construction materials such as hardwood flooring. Pneumatic nailers are often used for this purpose, although there exist different types of nailers. Conventional pneumatic nailers are provided with a main body having an elongated nail ejection channel therein for receiving a nail from a nail magazine carried by the nailer main body. The nail is to be ejected more particularly through a nail outlet of the nail ejection channel leading out of the main body. A plunger carried within and movable along the nail ejection channel is actuated by an actuator for ejecting the nail out of the nail outlet.

This type of nailer is also provided with a sole at its lower end, the sole having a horizontal sole bearing surface there under on which the nailer will rest on the ground. The nailer also has a vertical abutment surface close to the nail outlet. When a nail is to be driven through a wooden board being installed as part of the hardwood flooring, the nailer is consequently applied against the board upper surface with its sole resting on the wooden board upper exposed surface and with its vertical abutment surface abutting against a lateral edge of the wooden board. It is noted that most conventional wooden boards include one lateral edges provided with an elongated tongue that extends longitudinally there along, and that the nail is intended to be driven through the wooden board lateral surface at the intersection between the recessed vertical lateral wall and the protruding elongated tongue. The nailer vertical abutment bearing surface usually abuts more specifically against this tongue which forms part of the wooden board lateral edge. Upon this position being achieved, the nailer ejection channel should be properly aligned with respect to the wooden board to drive a nail diagonally through its lateral edge so that the nail will extend through the wooden board and downwardly beyond the board into the sub-floor.

A problem with conventional nailers such as the one detailed hereinabove is that they are adapted to work with a very narrow range of hardwood flooring board types. More specifically, in the prior art nailers, the position of the nail ejection channel relative to its sole and to its vertical abutment surface is fixed, and consequently these two elements that act to guide the user of the nailer into properly positioning the nailer before ejecting the nail, cannot accommodate wooden boards of different configuration. Therefore, the nailers can only be used with a single wooden board type or at best with a narrow range of wooden board types.

SUMMARY OF THE INVENTION

The present invention relates to a nailer comprising:

a main body;

an elongated nail ejection channel in said main body for receiving a nail to be ejected and including a nail outlet leading out of said main body;

a plunger carried within and movable along said nail ejection channel;

an actuator capable of moving said plunger along an ejection axis in said nail ejection channel for selectively ejecting the nail out through said nail outlet;

a first guide member carried by and movable relative to said main body, for engaging a first reference surface outboard of said nailer; and a first adjuster mechanism capable of adjusting the position of said first guide member relative to said main body;

wherein the position of said nail ejection channel can be adjusted relative to the first reference surface with said first adjuster mechanism when said nailer engages the first reference surface with said first guide member.

In one embodiment, said main body defines opposite upper and lower ends with said nail outlet being located at said lower end, said first guide member comprising a sole carried by said main body at said lower end thereof, said sole defining a substantially flat sole bearing surface oriented away from said main body for resting on the first reference surface and a sole attachment surface opposite said sole bearing surface, with said sole attachment surface movably attached to said main body.

In one embodiment, said first adjuster mechanism comprises a first lug and track member attached to said main body and a corresponding second lug and track member attached to said sole and operative on said sole attachment surface thereof, said first and second lug and track members being complementary and slidably interconnected and thus allowing a translational displacement of said main body relative to said sole, said first adjuster mechanism further comprising a control member to control the position of said sole relative to said main body.

In one embodiment, said translational displacement of said main body relative to said sole is accomplished in a translational direction which intersects said ejection axis.

In one embodiment, said translational direction and said ejection axis are angularly spaced apart of approximately 45°.

In one embodiment, said control member comprises a cam member rotatably mounted to said second lug and track member, and a rod eccentrically engaging said cam member and said first lug and track member, whereby rotation of said cam member will impart said translational displacement of said main body relative to said sole.

In one embodiment, said control member further comprises a setting member for releasably setting the relative position of said main body and said sole once this relative position has been adjusted with said cam member.

In one embodiment, said sole is releasably movably attached to said main body.

In one embodiment, said sole is releasably attached to said second lug and track member.

In one embodiment, the nailer further comprises:

a second guide member carried by and movable relative to said main body, for engaging a second reference surface outboard of said nailer; and a second adjuster mechanism capable of adjusting the position of said second guide member relative to said main body;

wherein the position of said nail ejection channel can be adjusted relative to the second reference surface with said second adjuster mechanism when said nailer engages the second reference surface with said second guide member.

In one embodiment, said main body defines opposite upper and lower ends and a longitudinal axis there between, with said nail outlet being located at said lower end, said first guide member comprising a sole carried by said main body at said lower end thereof, said sole defining a substantially flat sole bearing surface oriented away from said main body for resting on the first reference surface and a sole attachment surface opposite said sole bearing surface, with said sole attachment surface movably attached to said main body, said second guide member comprising an abutment block carried by said main body at said lower end thereof, said abutment block defining an abutment block attachment surface movably attached to said main body and an abutment block bearing surface which is parallel to said longitudinal axis, said abutment block bearing surface for abutting on the second reference surface.

In one embodiment, said nail outlet is located between said sole and said abutment block at said main body lower end.

In one embodiment, said abutment block bearing surface is perpendicular to said sole bearing surface.

In one embodiment, said first adjuster mechanism comprises a first lug and track member attached to said main body and a corresponding second lug and track member attached to said sole and operative on said attachment surface thereof, said first and second lug and track members being complementary and slidably interconnected and thus allowing translational displacement of said main body relative to said sole in a first translational direction, said first adjuster mechanism further comprising a control member to control the position of said sole relative to said main body, and wherein said second adjuster mechanism comprises a first elongated slot and pin member provided on said abutment block and operative on said attachment surface thereof and a corresponding second elongated slot and pin member provided on said main body, said first and second elongated slot and pin members being-complementary and slidably interconnected and thus allowing translational displacement of said main body relative to said abutment block in a second translational direction.

In one embodiment, said first and second translational directions are transversal to each other.

In one embodiment, said first translational direction is parallel to said longitudinal axis and perpendicular to said sole bearing surface, and said second translational direction is transversal to said longitudinal axis and to said abutment block bearing surface and parallel to said ejection axis.

In one embodiment, the nailer further comprises a security plunger blocking member selectively releasably engageable in said nail ejection channel to thus selectively prevent the movement of said plunger in said nail ejection channel for preventing accidental ejection of the nail out of said nail outlet.

In one embodiment, said security plunger blocking member comprises:

- a blocking arm pivotally carried by said main body and pivotable between an inserted position in which said blocking arm engages said nail ejection channel and a retracted position in which said blocking arm clears said nail ejection channel;
- a biasing member continuously biasing said blocking arm towards said inserted position; and
- a blocking arm trigger carried by said main body and movable between a first position in which it extends beyond said first guide member relative to said main body and in which said blocking arm is allowed to remain in said inserted position through the action of said biasing member, and a second position in which said trigger forces said blocking arm into said retracted position against the bias of said biasing member;

wherein upon said nailer being applied against the first reference surface with said first guide member abutting against the first reference surface, said trigger will be moved from said first to said second position for concurrently forcing said blocking arm from said inserted to said retracted position, thus allowing a nail to be ejected from said nail ejection channel.

DETAILED DESCRIPTION OF THE EMBODIMENTS

Figure 1:
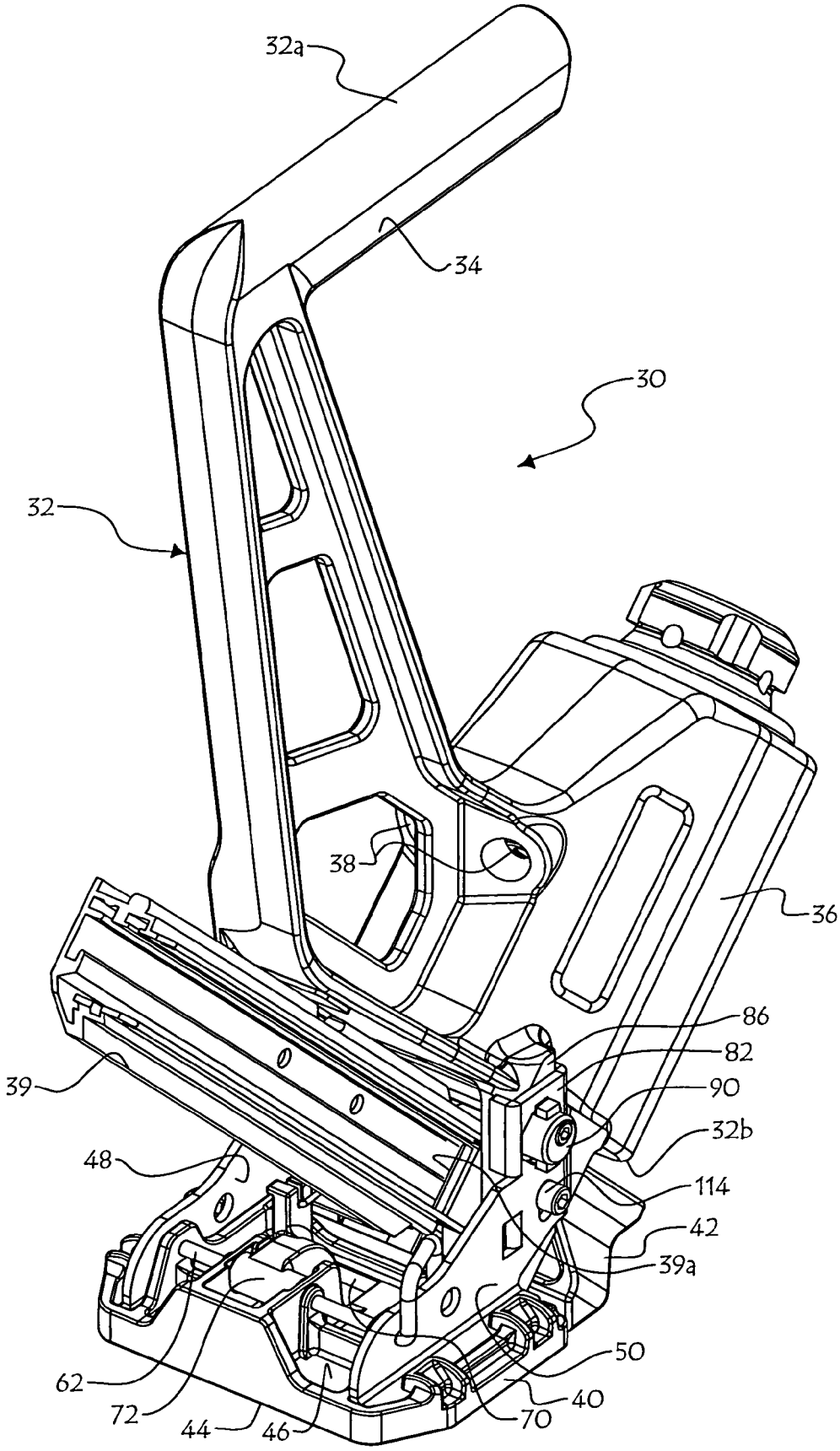
FIG. 1 is a rear perspective view of the nailer of the present invention.
Figure 2:
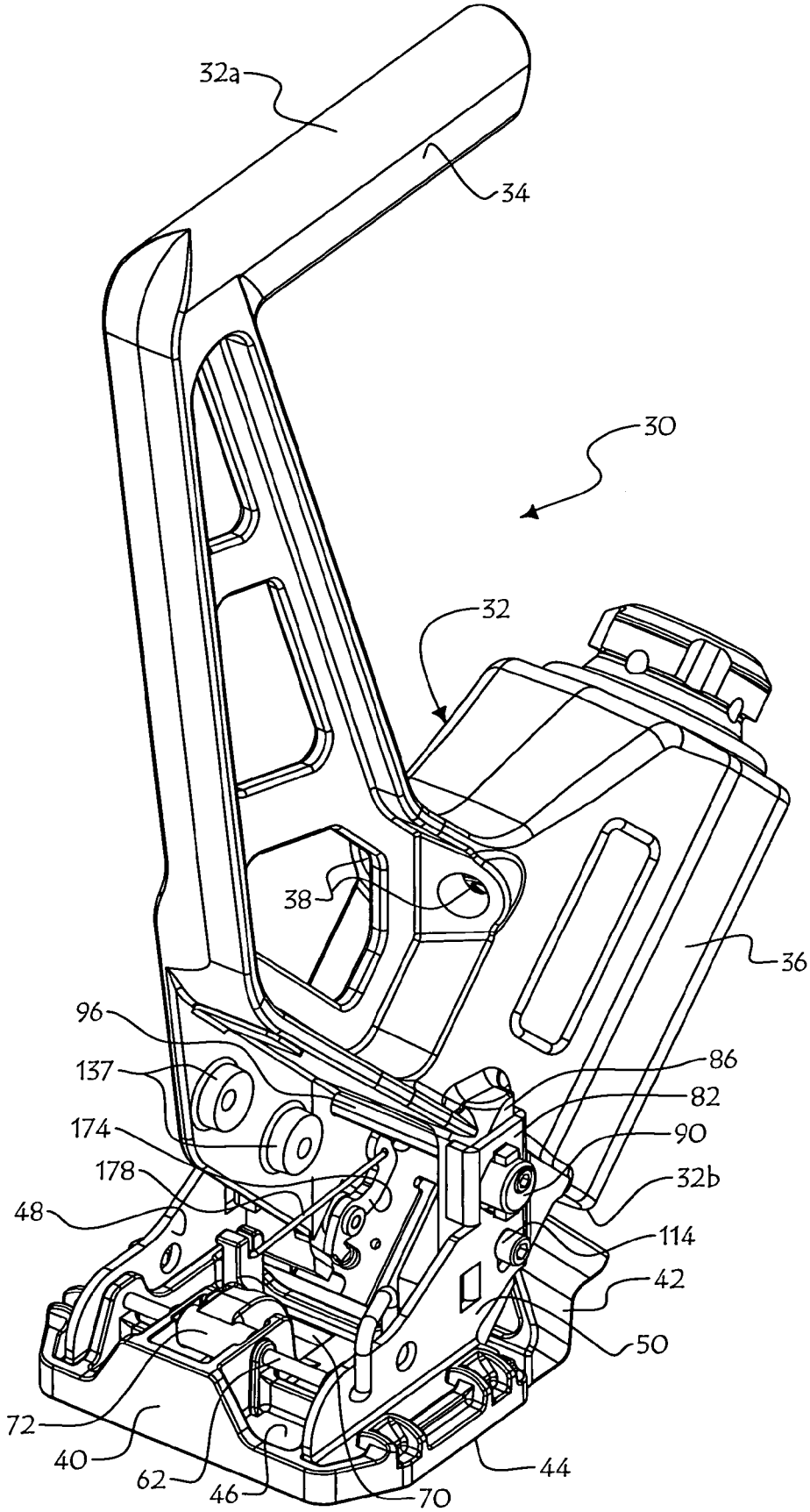
FIG. 2 is similar to FIG. 1, but with the nail magazine removed.
Figure 3:
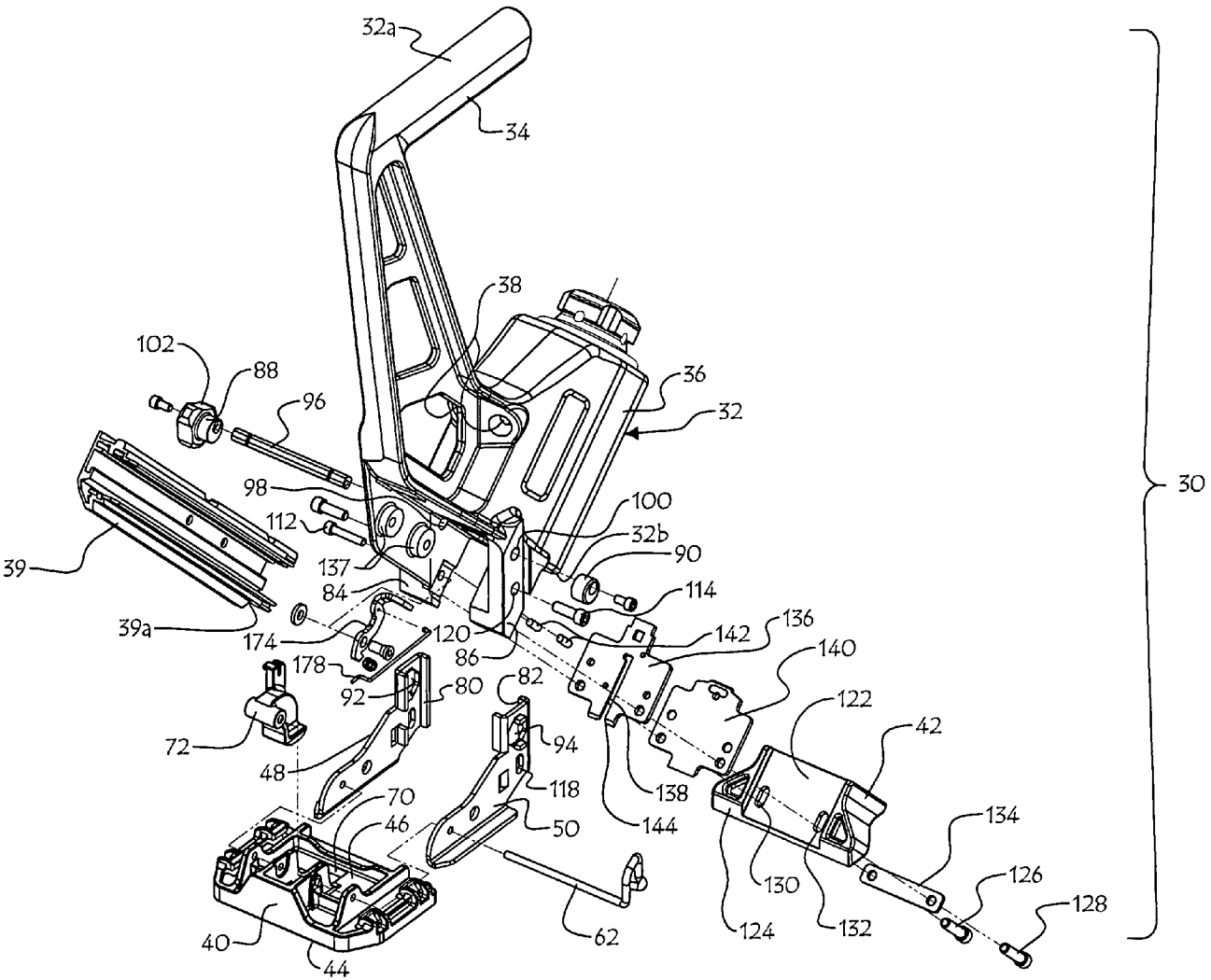
FIG. 3 is a rear exploded perspective view of the nailer of FIG. 1.

In the annexed drawings, FIGS. 1-3 show a pneumatic nailer 30 according to the present invention. It is understood that nailers with other alternate actuator means than the conventional pneumatic pressure could be used, although the following description will detail a pneumatic nailer.

Nailer 30 is destined to be used to nail wooden boards to a sub-floor (not shown) for forming a surface of hardwood flooring, although it is not limited to such a purpose. To this end, the user of nailer 30 will strike the head portion of nailer 30 as described hereinafter with a hammer, to activate the pneumatically pressurized nailer 30 that will drive a nail through a wooden board.

Nailer 30 comprises a main body 32 defining opposite upper and lower ends 32*a*, 32*b* and a longitudinal axis there between. Nailer 30 has a handle 34 at its upper end 32*a* and an actuation chamber 36. A pair of pressurized air inlet ports 38, 38 are provided on actuation chamber 36. Pneumatic air hoses (not shown) are destined to be operatively connected to inlet ports 38, 38 to feed pressurized air to nailer 30, as known in the art. A nail magazine 39 is releasably carried by main body 32, for loading a number of nails (not shown) therein in a known manner. In the embodiment of nailer 30 shown in the drawings, the nails are linked together with a frangible adhesive to allow the front most nail to detach from the other interconnected spring-loaded nails when nailer 30 is activated and the front most nail is driven out of the nailer. It is noted that other ejectable fasteners than nails could alternately be used.

Two guide members in the form of a sole 40 and an abutment block 42 are carried by main body 32, at the lower end 32*b* thereof.

Figure 6:
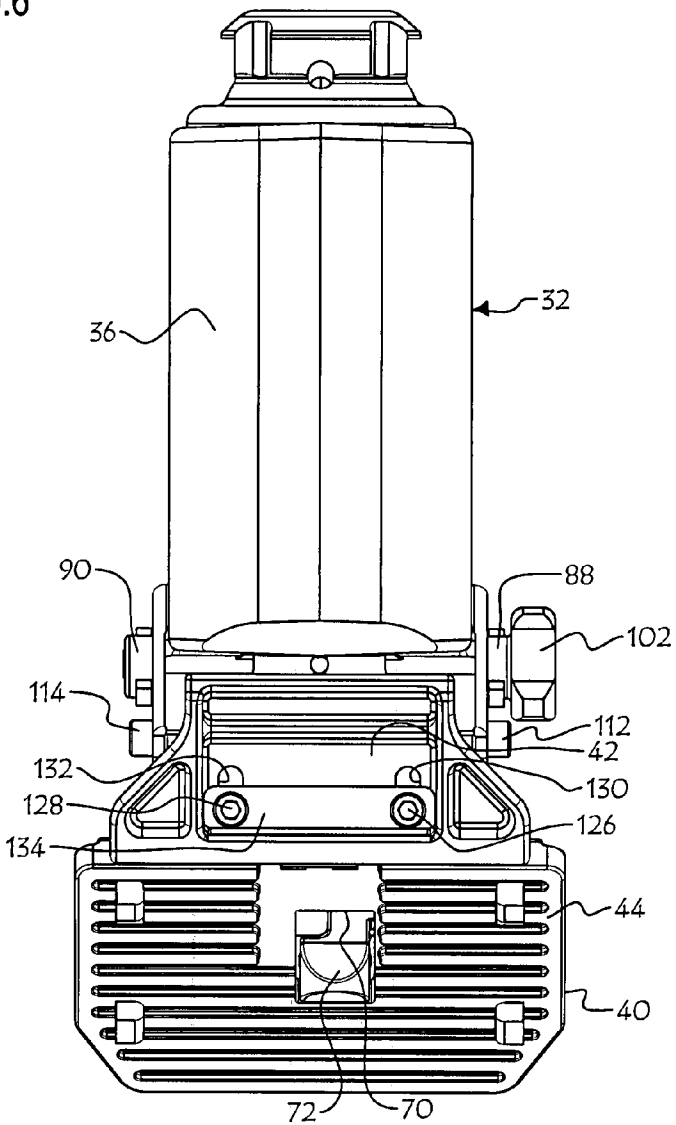
FIGS. 5 and 6 are respectively side and front elevations of the nailer of FIG. 1, with the nail magazine being removed and with the handle being only partly shown in FIG. 5.
Figure 5:
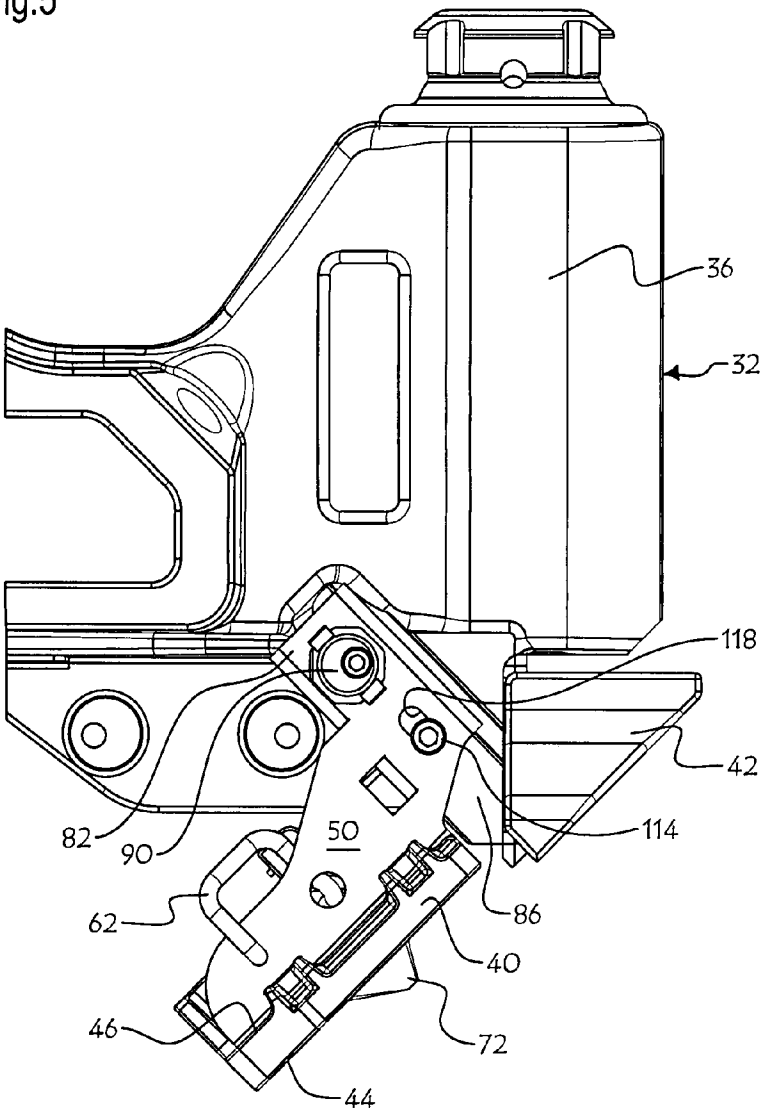

Sole 40, as best shown in FIGS. 1-6, defines a substantially flat bearing surface 44 oriented away from main body 32 for resting on a reference surface which will normally be the upper exposed flat surface of a wooden board to be installed as part of hardwood flooring as detailed hereinafter. The sole bearing surface 44 is ribbed (FIG. 6). Sole 40 also defines an attachment surface generally referred to with numeral 46 and located opposite bearing surface 44. Attachment surface 46 is movably attached to nailer main body 32 by means of a pair of track members 48, 50 that are symmetrically identical—only one track member 50 and its attachment to sole 40 and main body 32 will hereafter be described, but it is understood that a similar description for the other track member 48 is applicable.

Figure 4:
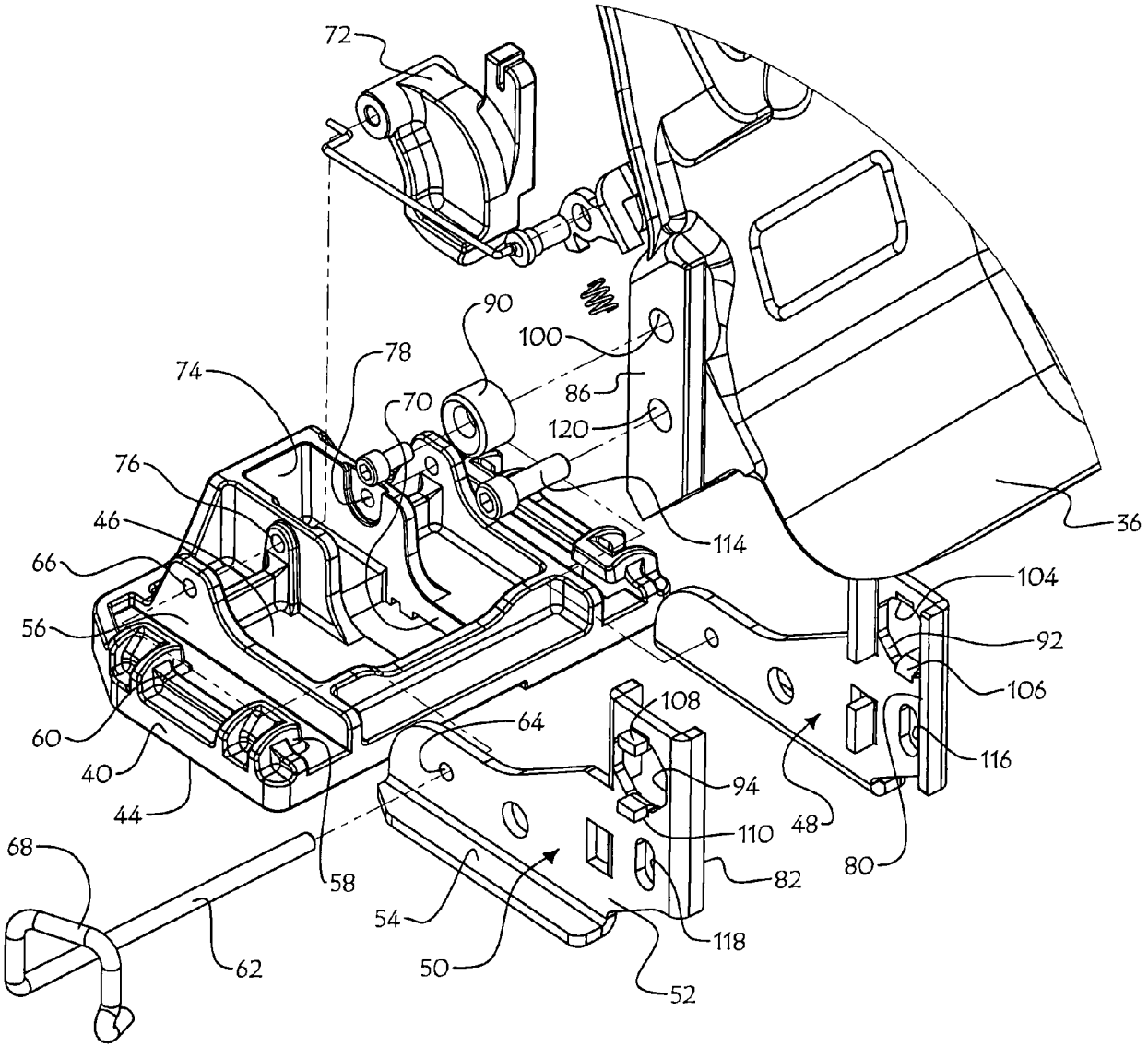
FIG. 4 is a partial front exploded perspective view, at an enlarged scale, of the nailer of FIG. 1, showing more particularly the sole, the track members and the lower portion of the nailer main body.

As shown in FIG. 4, track member 50 has a first cross-sectionally L-shaped portion that comprises a side wall 52 to which a bottom wall 54 is integrally attached at a right angle. Track member 50 engages sole 40 through the instrumentality of an inner upstanding flange 56 integrally attached to the sole attachment surface 46, with track member side wall 52 being parallel to and abutting on flange 56. A pair of inwardly bent outer fingers 58, 60 are integrally fixed to sole 40, close to although spaced from flange 56, with track member 50 further engaging sole 40 through the instrumentality of its bottom wall 54 being inserted between fingers 58, 60 and sole attachment surface 46. Side wall 52 is thus inserted between flange 56 and fingers 58, 60 of sole 40. A pin 62 extends through coaxially aligned holes 64 and 66 respectively made in track member side wall 52 and sole flange 56 (pin 62 in fact extending across sole 40 to also engage the other track member 48 and its corresponding sole flange). Pin 62 has an elbowed portion 68 that is bent inwardly over side wall 52 and flange 56 to prevent accidental disengagement of pin 62.

This attachment of track members 48, 50 to sole 40 allows sole 40 to be releasably attached to main body 32. Indeed, by resiliently forcing the elbowed portion 68 of pin 62 over side wall 52 and flange 56, pin 62 can be removed and sole 40 can slide out of its engagement between flanges 56, fingers 58, 60 and sole attachment surface 46.

Back to FIGS. 1-6, and as best shown in FIG. 4, it can be seen that sole 40 further comprises a central hole 70 and pivotally carries a trigger 72 that is pivotally mounted to a central portion of pin 62 between two parallel central support wall portions forming part of a U-shaped central wall 74 on sole attachment surface 46. Pin 62 extends through holes 76, 78 made in wall 74. Trigger 72 is movable between a first position in which it extends beyond the sole bearing surface 44 relative to the nailer main body 32, and a second position in which it is retracted within hole 70 and is located entirely above sole bearing surface 44.

FIGS. 1-6 further show that track members 48, 50 are equipped on their vertical wall portion with U-shaped tracks 80, 82; while the nailer main body 32 comprises a pair of lug members 84, 86 that are complementary to tracks 80, 82 respectively and that allow slidable interconnection and consequently translational displacement of main body 32 relative to sole 40.

It is understood that although tracks 80, 82 are provided on track members 48, 50 and lug members 84, 86 are provided on main body 32, the opposite would be equally workable. It can thus generally be said that use of complementary lug and track members 80, 82, 84, 86 attached on the one hand to sole 40 and operative on its attachment surface 46, and on the other hand to main body 32, is appropriate to carry out this specific embodiment of the invention. These lug and track members 80, 82, 84, 86 form part of a sole adjuster mechanism that is capable of adjusting the position of sole 40 relative to main body 32.

This sole adjuster mechanism further comprises a control member to control the position of sole 40 relative to main body 32, in the form of a cam member including a pair of cylindrical cams 88, 90 rotatably mounted into larger-sized holes 92, 94 (FIGS. 3-4) made in track members 48, 50, respectively. Cams 88, 90 are cylindrical in shape, and comprise axially aligned eccentric bores therein threadingly engaged by a rod 96 that also extends through holes 98, 100 made in lug members 84, 86. Rod 96 has a cylindrical peripheral surface except at its extremities where it is preferably of irregular shape, e.g. polygonal, with the bores in cams 88, 90 being of complementary irregular shape to ensure a concurrent rotation of rod 96 and cams 88, 90. Also, the track member holes 92, 94 are provided with small shoulder blocks 104, 106, 108, 110 (see FIG. 4) peripherally located at the upper and lower extremities of holes 92, 94, or in other words at the twelve o'clock and six o'clock angular positions when nailer 30 stands upright. These shoulder blocks 104, 106, 108, 110 slidably snugly engage the outer peripheral surface of cams 88, 90. Consequently, rotation of cams 88, 90 is allowed within holes 92, 94, as cams 88, 90 will slide on blocks 104, 106, 108, 110. This rotation of cams 88, 90 will impart a translational displacement of the nailer main body 32 relative to sole 40 along the nailer longitudinal axis. Indeed, the rotation of cams 88, 90 in holes 92, 94 will result in a horizontal displacement of cams 88, 90 therein due to the eccentric engagement of rod 96 in cams 88, 90, with the larger diameter of holes 92, 94 allowing cams 88, 90 to move horizontally therein. However, the slidable engagement of cams 88, 90 on shoulder blocks 104, 106, 108, 110 prevents any vertical displacement of cams 88, 90 in holes 92, 94, instead forcing rod 96 into a vertical displacement. This vertical displacement of rod 96 will force a corresponding vertical movement of lug members 84, 86 that are slidably penetrated by rod 96, relative to track members 48, 50 that carry cams 88, 90. Thus, main body 32 is moved in vertical translation when cams 88, 90 are rotated. A knob 102 is integrally attached to cam 88 to facilitate manual intervention on the cams 88, 90 and rod 96 assembly by a user.

The control member of the sole adjuster mechanism further comprises a setting member in the form of a pair of set screws 112, 114 that engage elongated slots 116, 118 in track members 48, 50 and threaded holes 120 in lug members 84, 86 (only one hole 120 in lug member 86 is visible in FIGS. 3 and 4, holes 120 of both lug members 84, 86 are concealed in all other figures). Set screws 112, 114, when tightened, releasably set the relative position of main body 32 and sole 40 once this relative position has been adjusted with cam members 88, 90.

Abutment block 42 defines an attachment surface 122 movably attached to said nailer main body 32 and a bearing surface 124 parallel to the nailer longitudinal axis for abutting on a reference surface in the form of the side edge surface of the wooden board to be nailed. Consequently, in this embodiment of the nailer of the present invention, abutment block bearing surface 124 and sole bearing surface 44 are perpendicular to one another, although alternate differential angular configurations could be envisioned.

Figure 3A:
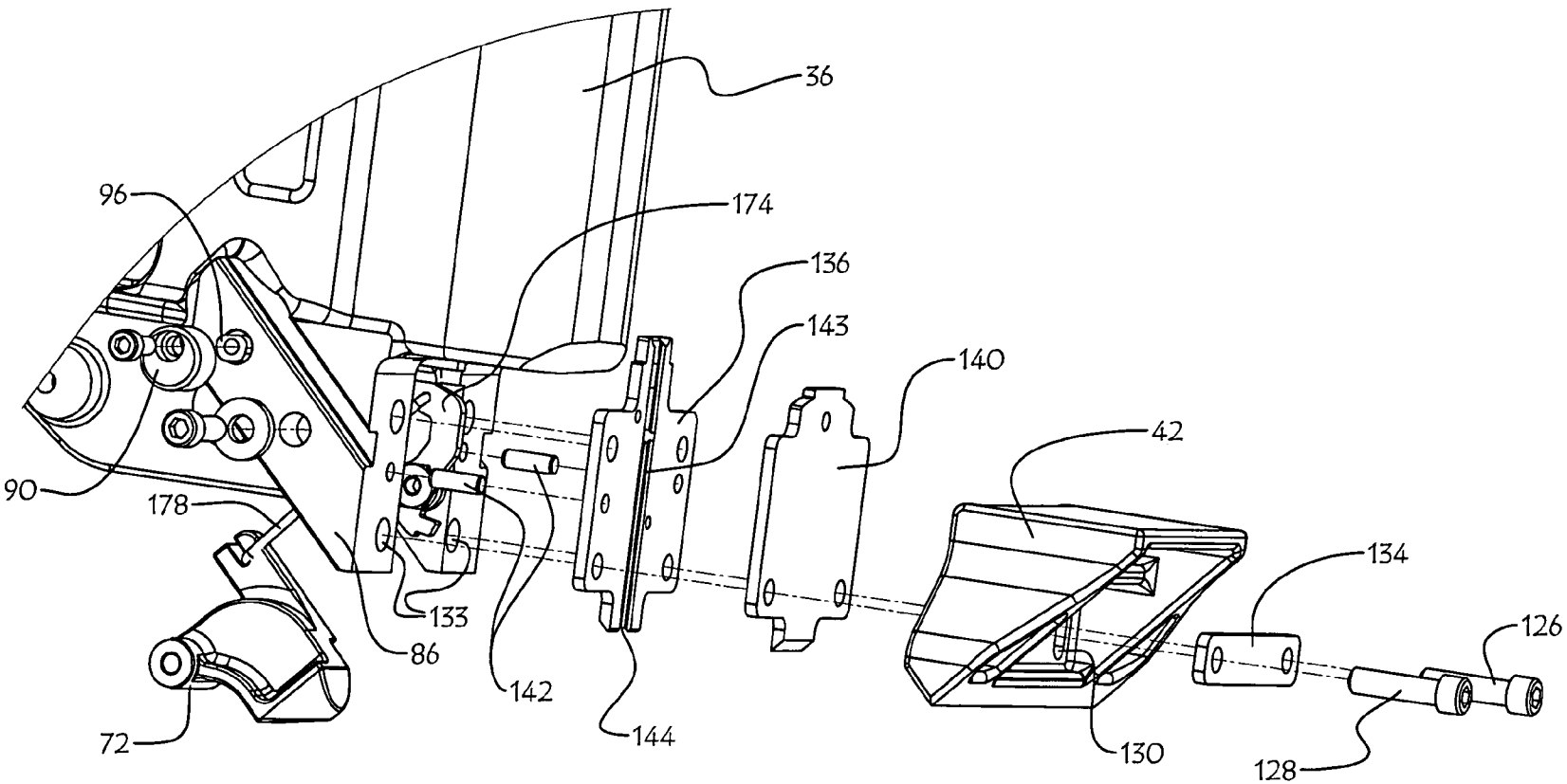
FIG. 3A is a partial front exploded perspective view, at an enlarged scale, of the nailer of FIG. 1, showing more particularly the abutment block, the two plates forming the nail ejection channel and the lower portion of the nailer main body.

Abutment block 42 is movably attached to nailer main body 32 by means of a pair of pins in the form of set screws 126, 128 that engage abutment block 42 through a pair of elongated slots 130, 132 (FIGS. 3, 3A and 6) and that are then engaged in a pair of threaded holes 133,133 (FIG. 3A) in main body 32 near the bottom extremity of lug members 84, 86. A washer plate 134 is provided between the screw heads and abutment block 42. The position of abutment block 42 relative to nailer main body 32 can consequently be adjusted by loosening set screws 126, 128, sliding abutment block 42 along main body 32 as allowed by the engagement of the shafts of set screws 126, 128 in the elongated slots 130, 132, and once the desired position is obtained, tightening screws 126, 128 once again.

Of course, the elongated slots engaged by the set screws could alternately be provided on the main body while the holes would be provided on the abutment block, and it can generally be said that the sliding engagement of abutment block 42 along main body 32 and the set screw assembly that allows the abutment block displacement relative to the nailer main body, represent together an abutment block adjuster mechanism that comprises a first elongated slot and pin member provided on abutment block 42 and operative on the attachment surface 122 thereof and a corresponding second elongated slot and pin member provided on the nailer main body 32, with the first and second elongated slot and pin members being complementary to allow slidable interconnection and thus translational displacement of the nailer main body 32 relative to abutment block 42.

Nail magazine 39 is releasably installed on main body 32 by means of tracks (not shown) that engage a pair of cylindrical projections 137 (FIGS. 2 and 3) on main body 32. Nail magazine has a discharge end 39*a* that is located in the recess in main body 32 formed between the two lug members 84, 86. As suggested in FIG. 3, magazine discharge end 39*a* abuts against a nail inlet plate 136 that has a nail inlet opening 138 through which nails can be successively fed from nail magazine 39. Indeed, a number of aligned nails are spring-loaded in nail magazine 39 and continuously biased toward nail inlet opening 138. Nail inlet plate 136 flatly engages a nail seat plate 140 against which abutment block 42 bears, with both nail inlet plate 136 and nail seat plate 140 being fixed to main body 32 at its lower end 32*b* near lug members 84, 86, by means of the set screws 126, 128 that also engage abutment block 42. Alignment pins 142, 142 are further used to properly position nail inlet plate 136. Nail inlet plate 136 is further provided with an elongated groove on its surface that abuts against nail seat plate 140, thus defining an elongated nail ejection channel 143 (FIGS. 3A, 7-9 and 17-18) in nailer main body 32 for receiving therein from magazine 39 the front most nail of the series of nails to be ejected. A nail outlet 144, leading out of main body 32, is defined at the bottom extremity of nail ejection channel 143.

Nailer 30 is further provided with a plunger 146 carried within and movable along nail ejection channel 143, and an actuator capable of moving plunger 146 along an ejection axis in ejection channel 143 for ejecting a nail out of the nail outlet 144.

An exemplary actuator is shown in FIGS. 7-12, although it is to be understood that any suitable actuator other than the one herein described could be used. The actuator is housed within actuation chamber 36. More particularly, in use, plunger 146 will be moved as follows along the nail ejection axis.

Figure 7:
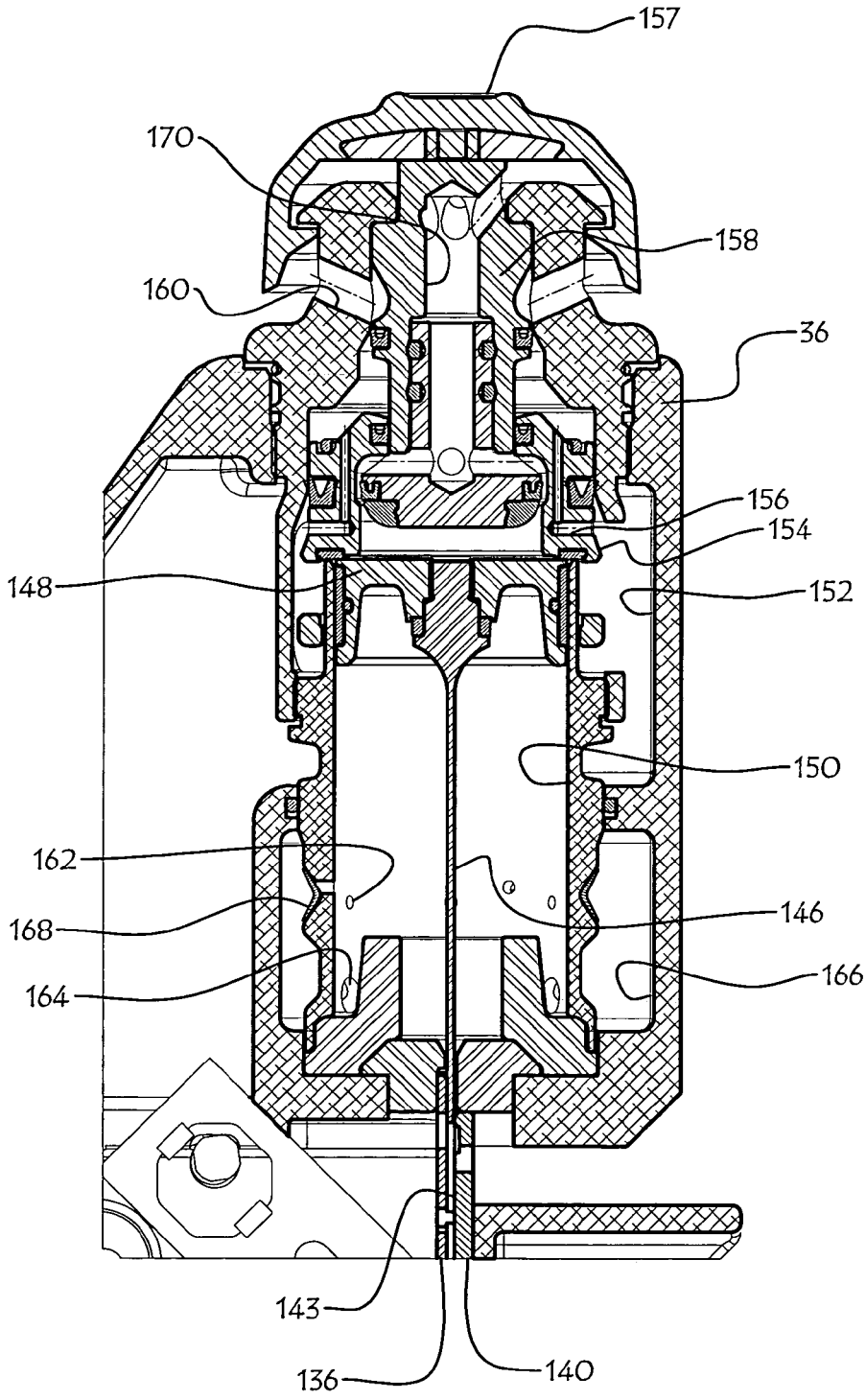
FIGS. 7 to 12 are side-cross-sectional views of the nailer actuator mechanism sequentially showing a cycle of the nail ejection actuation mechanism.

FIG. 7 shows plunger 146 in its initial retracted position. Plunger 146 is integrally fixed to a piston 148 movable within a piston chamber 150 which, in its portion underneath piston 148, is at a relatively low pressure at the outset. Piston chamber 150 is enclosed within a pressurized air intake chamber 152 located within actuation chamber 36 and connected to a pressurized air source through the instrumentality of pressurized air inlet ports 38, 38. A valve member 154 is coaxially sealingly seated atop piston chamber 150. Small air passages 156 allow air to seep axially through and over valve member 154 from air intake chamber 152.

Figure 8:
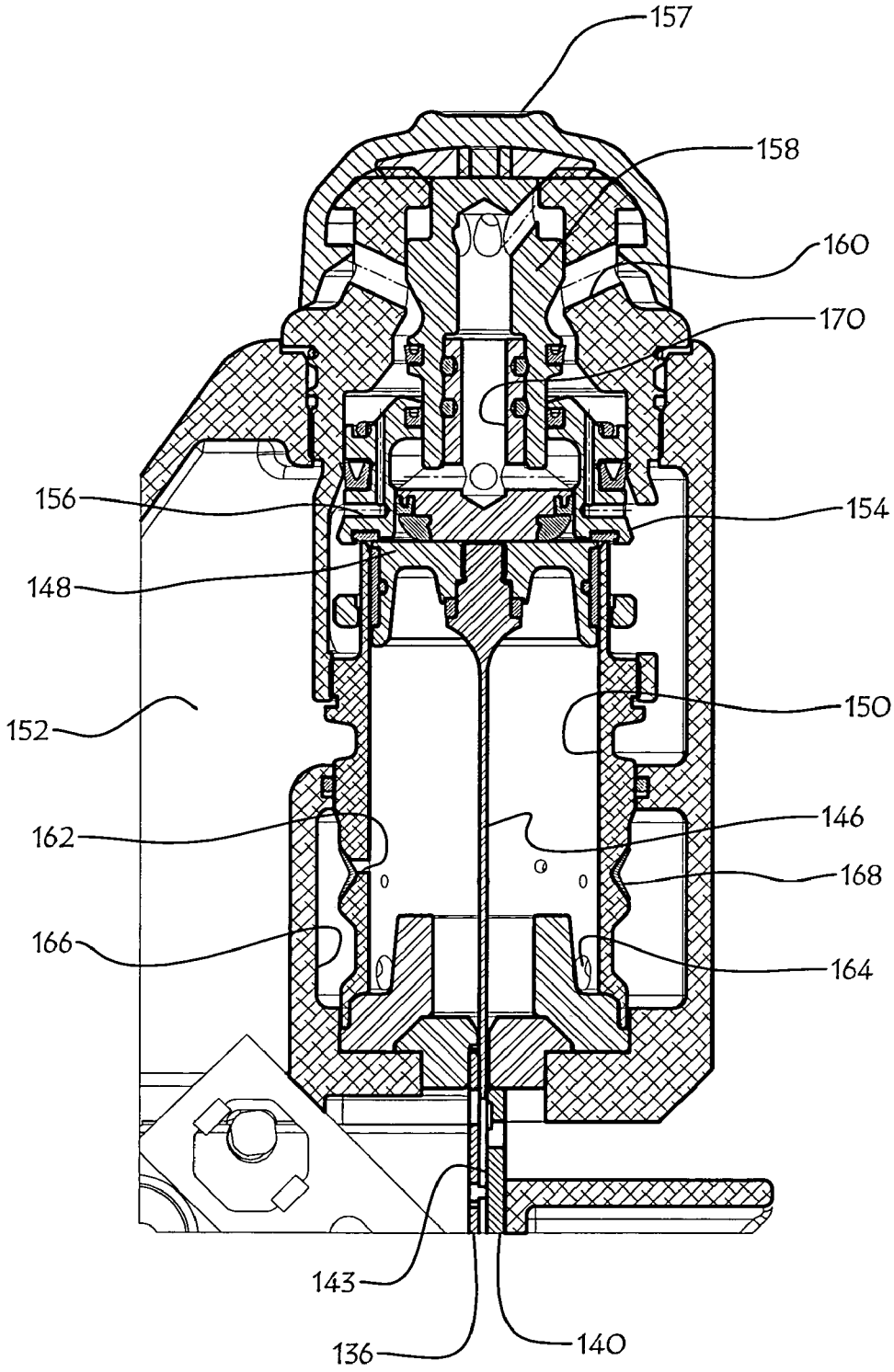
Figure 9:
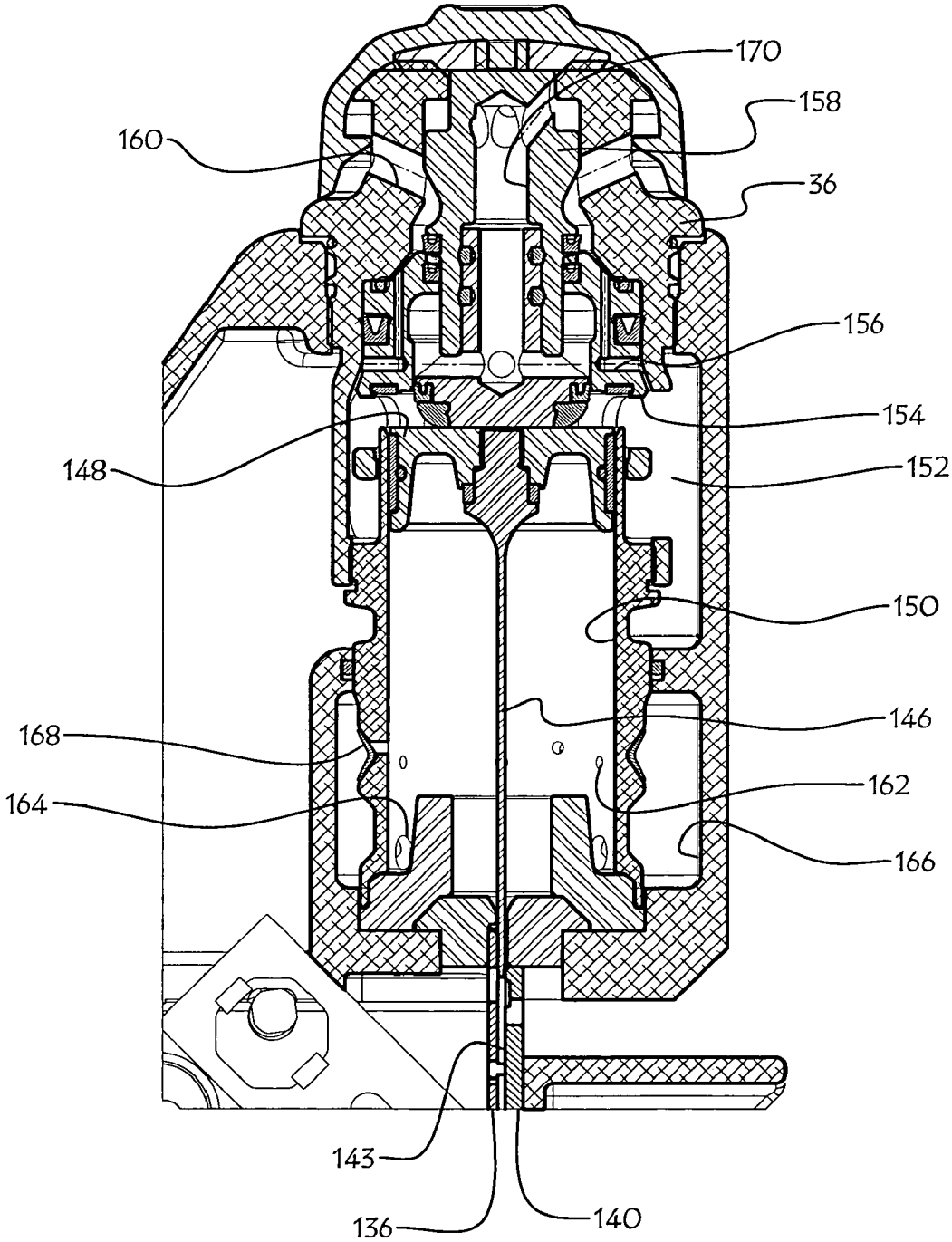
Figure 10:
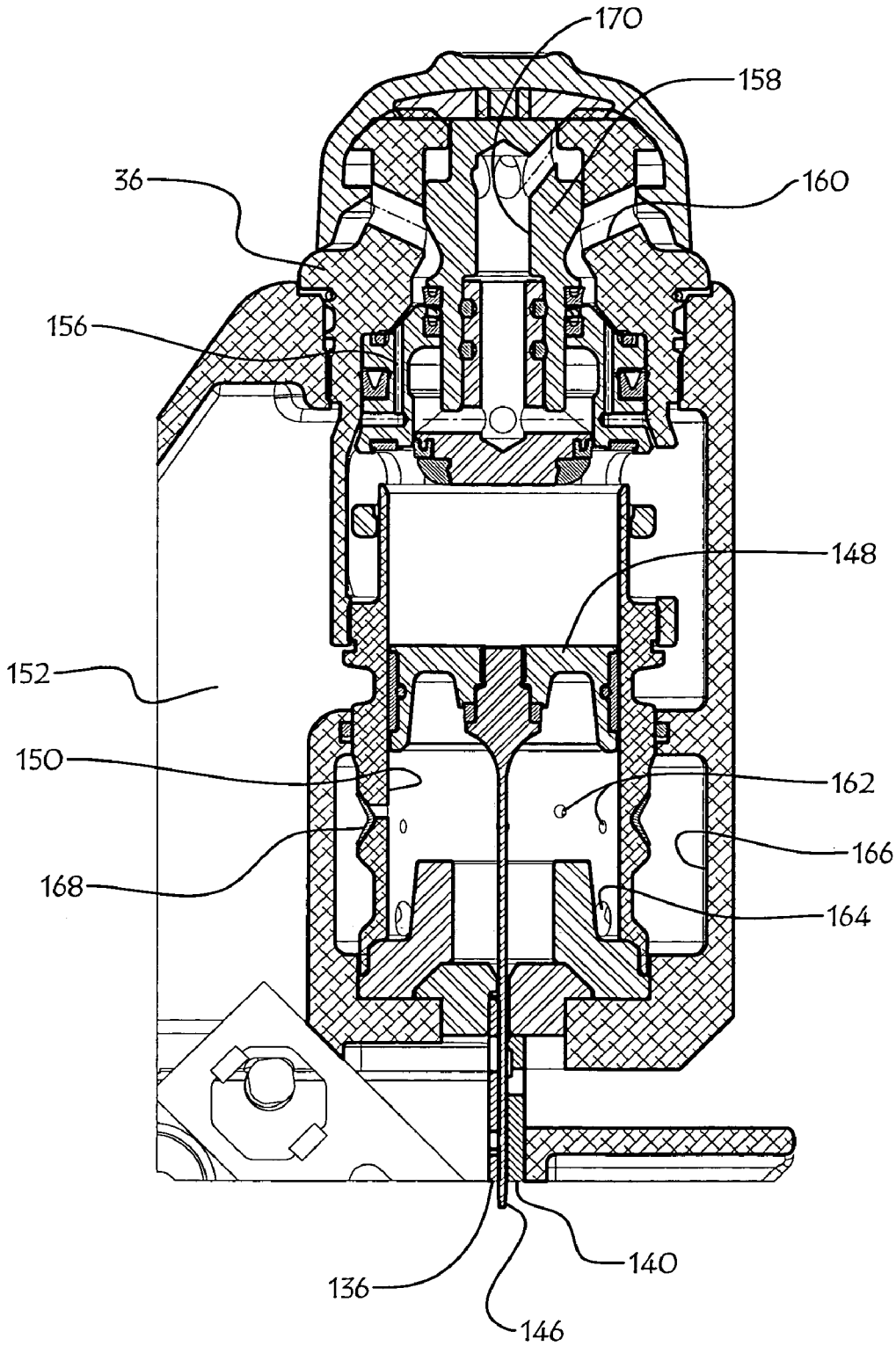

When a nail is to be driven out of nailer 30, plunger 146 must be moved along the nail ejection axis in the nail ejection channel 143 by first striking the outer striking surface 157 of actuator head portion 158 with a hammer. As shown in FIG. 8, this will move the actuator head portion 158 downwardly, allowing the pressurized air previously present over valve member 154 to be evacuated through top air outlets 160. Due to the high pressure in air intake chamber 152, valve member 154 will then be biased upwardly as shown in FIG. 9, freeing the upper surface of piston 148 that will then become affected by the air pressure in air intake chamber 152. This will result in piston 148 being driven downwardly as shown in FIG. 10.

As piston 148 moves downwardly, carrying plunger 146 with it, the air in the portion of piston chamber 150 that is located underneath piston 148 will be exhausted through holes 162 and 164 made in the lower portion of piston chamber 150, into an exhaust chamber 166. Holes 162 are covered with an elastic band 168 that will resiliently yield to allow air circulation out of chamber 150 but that will seal holes 162 to prevent backflow of air from exhaust chamber 166 into piston chamber 150. Holes 164 establish a free fluid communication between piston chamber 150 and exhaust chamber 166, i.e. there is no elastic band over holes 164.

Figure 11:
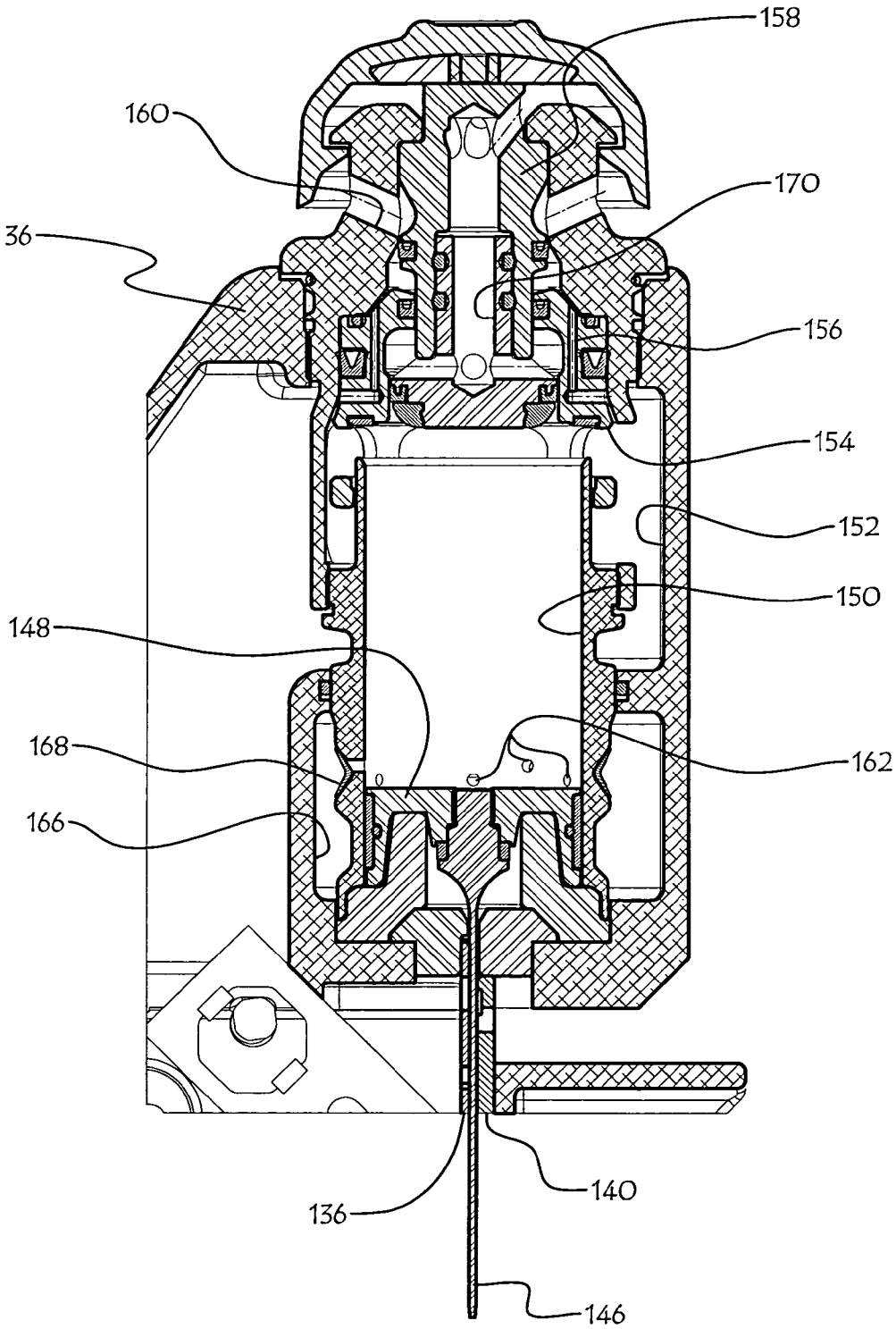
Figure 12:
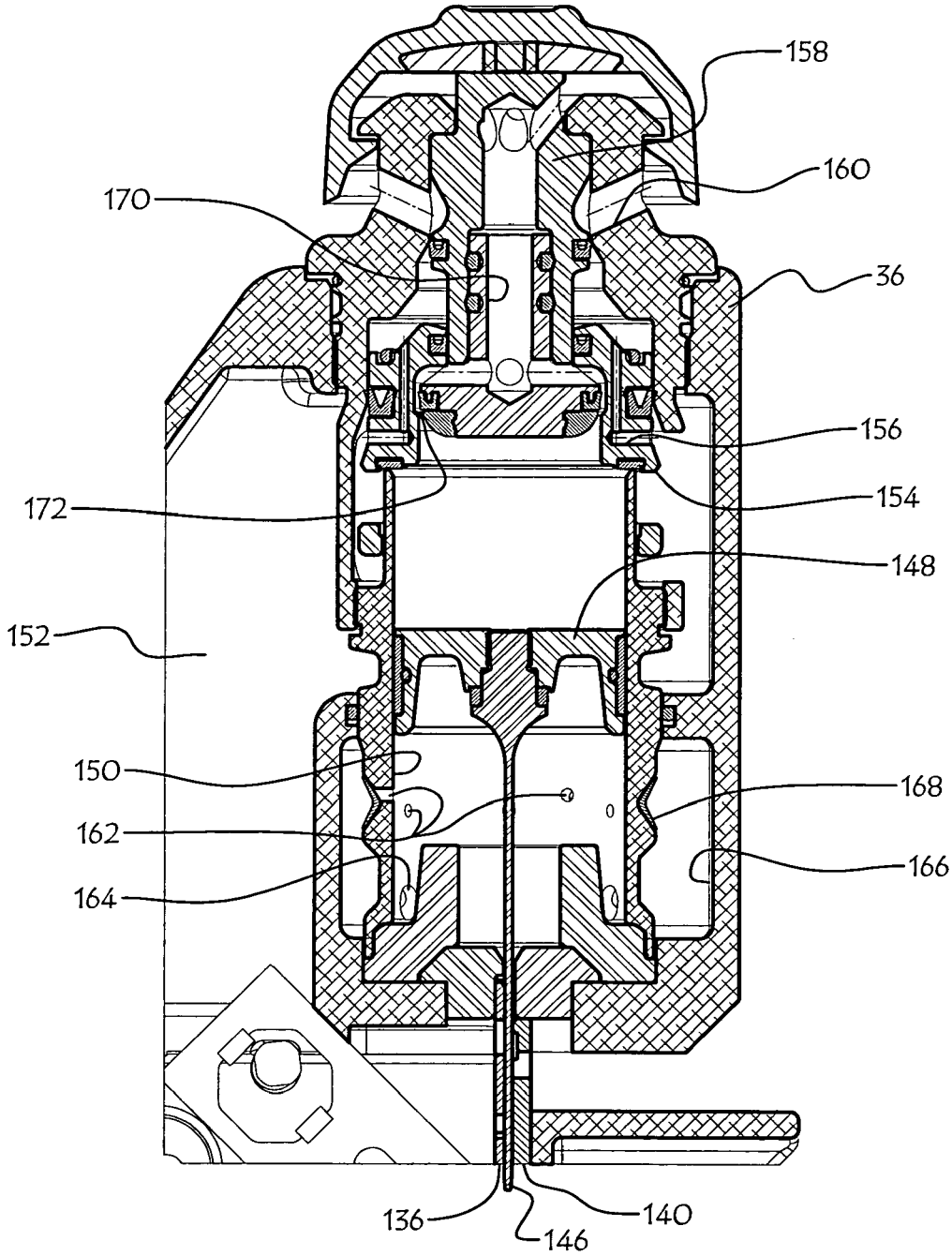
Figure 13:
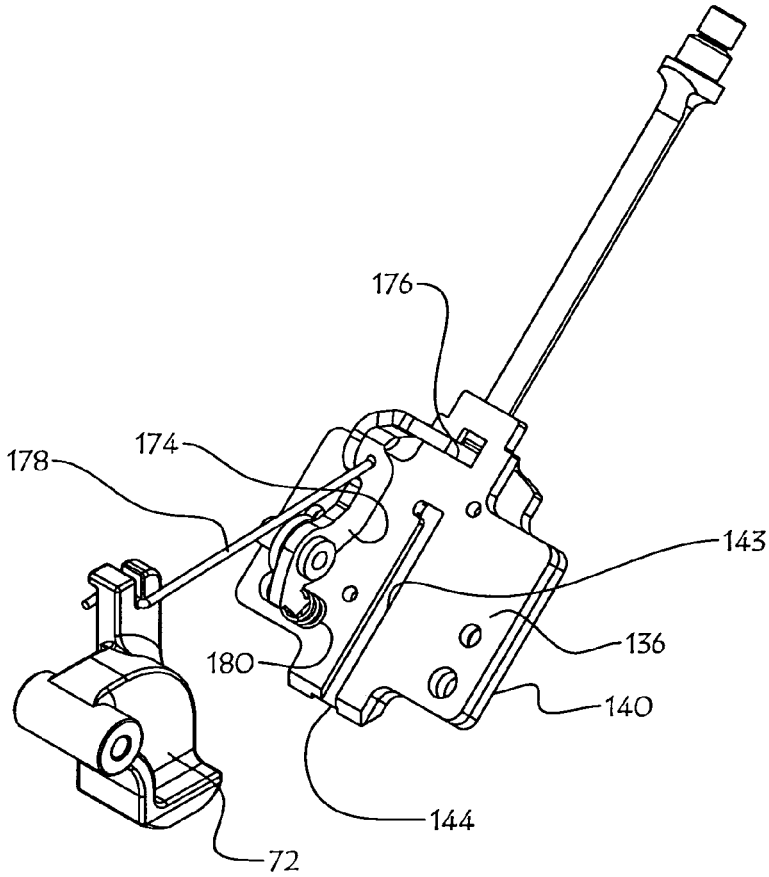
FIGS. 13 and 14 are respectively a rear perspective view and a side elevation of the plunger, the nail seat plate, the nail inlet plate and the security plunger blocking member of the nailer of FIG. 1 with the trigger in its first position and with the blocking arm in its inserted position.
Figure 14:
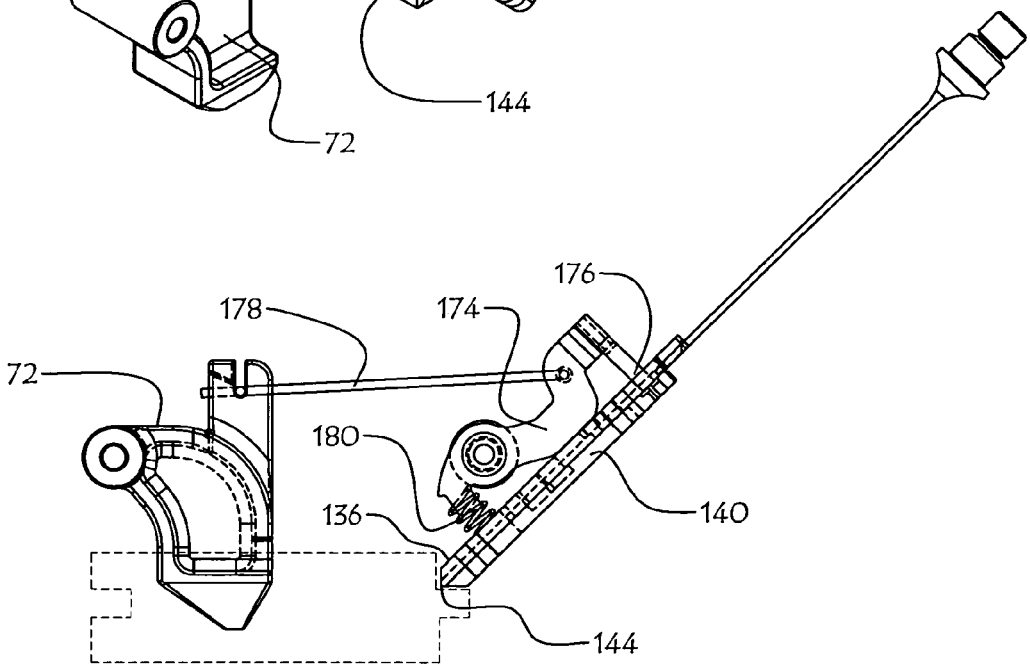

Upon piston 148 reaching a downward limit position corresponding to an extracted limit position of plunger 146 as shown in FIG. 11, most of the air in piston chamber 150 has been exhausted through holes 162, 164 into exhaust chamber 166. Not only that, but piston 148 downwardly clears holes 162 and consequently the pressurized air intake chamber 152 becomes in fluid communication with exhaust chamber 166, further pressurizing exhaust chamber 166. Also, as piston 148 moves downwardly from its initial position, the underface of actuator head portion 158 becomes exposed to the air pressure in intake chamber 152, and is biased upwardly to its initial raised position as further shown in FIG. 11. Actuator head portion 158 will consequently seal access to top air outlets 160, which will allow the pressurized air seeping through the small air passages 156 in valve 154 to gradually build up pressure above valve 154. Once this pressure build-up is sufficient (which only takes a few moments), valve 154 is biased downwardly back to its initial position in which it is sealingly seated against the top peripheral edge of piston chamber 150 as shown in FIG. 12. In this relative position of valve 154 and actuator head portion 158, air in the portion of piston chamber 150 located above piston 148 is allowed to be exhausted through a head passage network 170 in actuator head portion 158, flowing first through a small gap 172 (FIG. 12) formed between the lower portions of the actuator head portion 158 and valve 154.

High-pressure air in exhaust chamber 166 seeps through holes 164 and around and under piston 148, while elastic band 168 prevents air from flowing out of exhaust chamber 166 through holes 162. Once the high-pressure present in the portion of piston chamber 150 located above piston 148 is exhausted, the pressure located in chamber 150 under piston 148 will bias piston 148 upwardly as further shown in FIG. 12, until it reaches its upper limit position shown in FIG. 7. Exhaust chamber 166 and the portion of piston chamber 150 located underneath piston 148 thus both return to their relatively low-pressure initial state, and the actuator device is ready to be used again to drive another nail out of nailer 30. Indeed, as plunger moves upwardly to its initial retracted position in nail ejection channel 143, the spring loaded nails will move to position the next front most nail in the nail ejection channel 143 as known in the art.

Nailer 30 further comprises a security plunger blocking member selectively releasably engageable in nail ejection channel 143 to thus selectively prevent the movement of plunger 146 in nail ejection channel 143 for selectively preventing ejection of a nail out through nail outlet 144. More specifically, as shown in FIGS. 2, 3 and 13-16, the security plunger blocking member comprises a blocking arm 174 pivotally mounted to main body 32 through its pivotal attachment to nail inlet plate 136. Blocking arm 174 is pivotable between an inserted position (FIGS. 13, 14) in which it engages, with its outer free extremity 176, nail ejection channel 143; and a retracted position (FIGS. 15, 16) in which it clears nail ejection channel 143.

Figure 15:
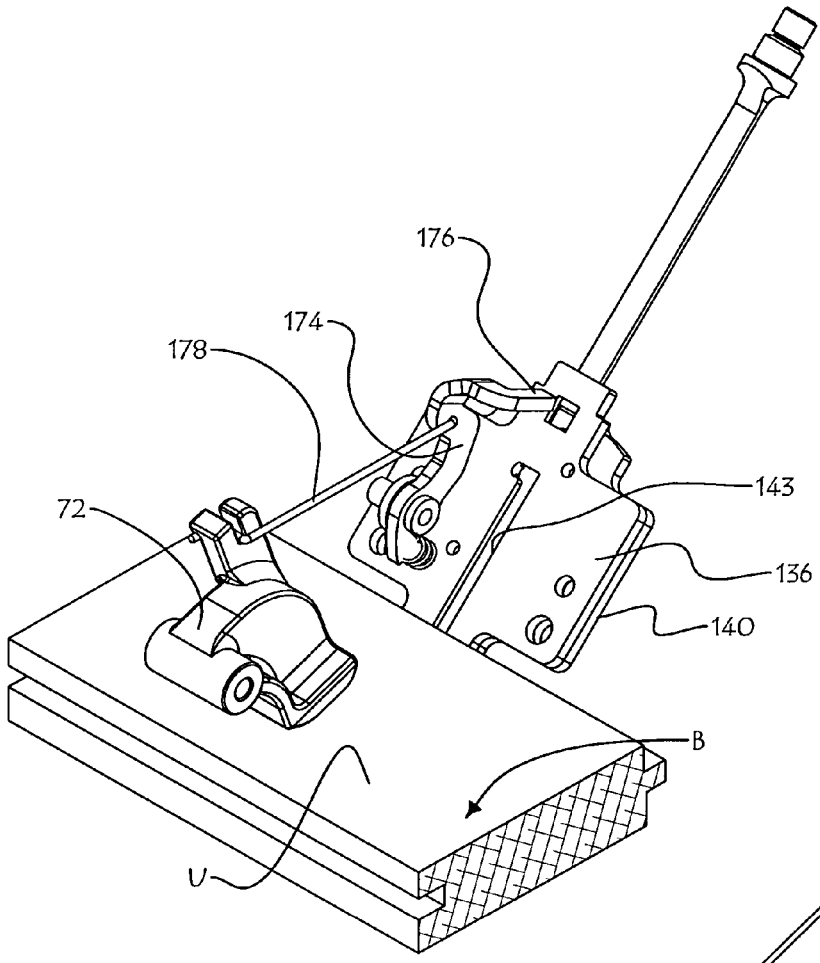
FIGS. 15 and 16 are respectively similar to FIGS. 13 and 14, but further show a board located adjacent the nailer elements shown in FIGS. 15 and 16 as it is located when the nailer operatively engages the board, with the trigger being in its second position and the blocking arm being in its extracted position.
Figure 16:
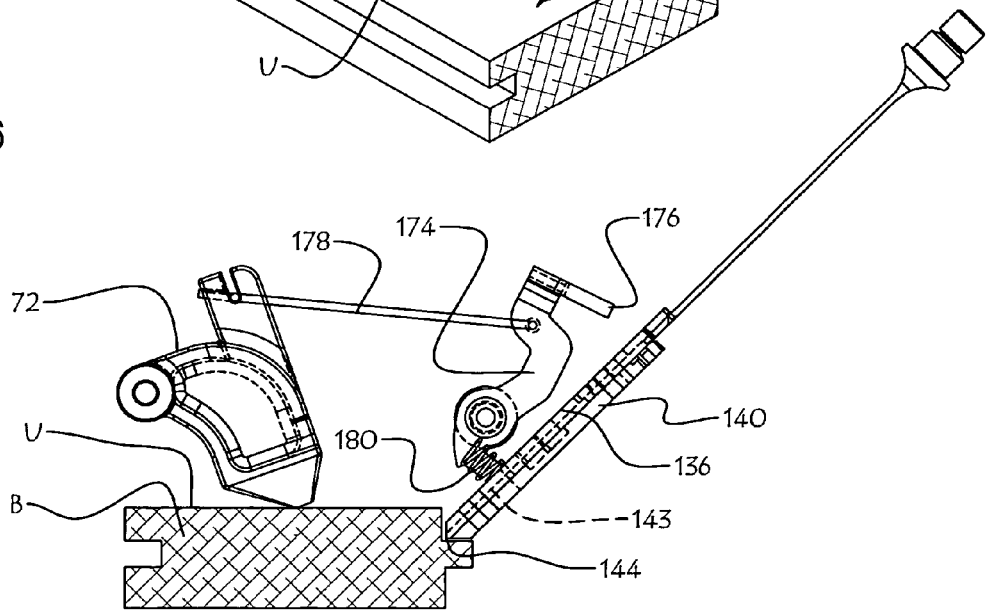

Blocking arm 174 is linked to trigger 72 by means of a rigid rod 178. A biasing member in the form of a spring 180 continuously biases blocking arm 174 towards its above-mentioned inserted position. This assembly allows blocking arm 174 to remain in its inserted position through the action of spring 180 when trigger 72 remains in its first position shown in FIGS. 13, 14; while blocking arm will be forced into its retracted position against the action of spring 180 when trigger 72 is moved to its second position as shown in FIGS. 15, 16. When blocking arm 174 is in its inserted position, the free extremity 176 thereof is located in the nail ejection channel downstream of the plunger free extremity, thus preventing the plunger from being moved towards a nail located in the nail ejection channel 143. In other words, when blocking arm 174 is in its inserted position, it prevents nailer 30 from ejecting nails. However, when blocking arm 174 is in its extracted position, its free extremity 176 clears the nail ejection channel and nailer 30 can operatively eject nails.

Figure 18:
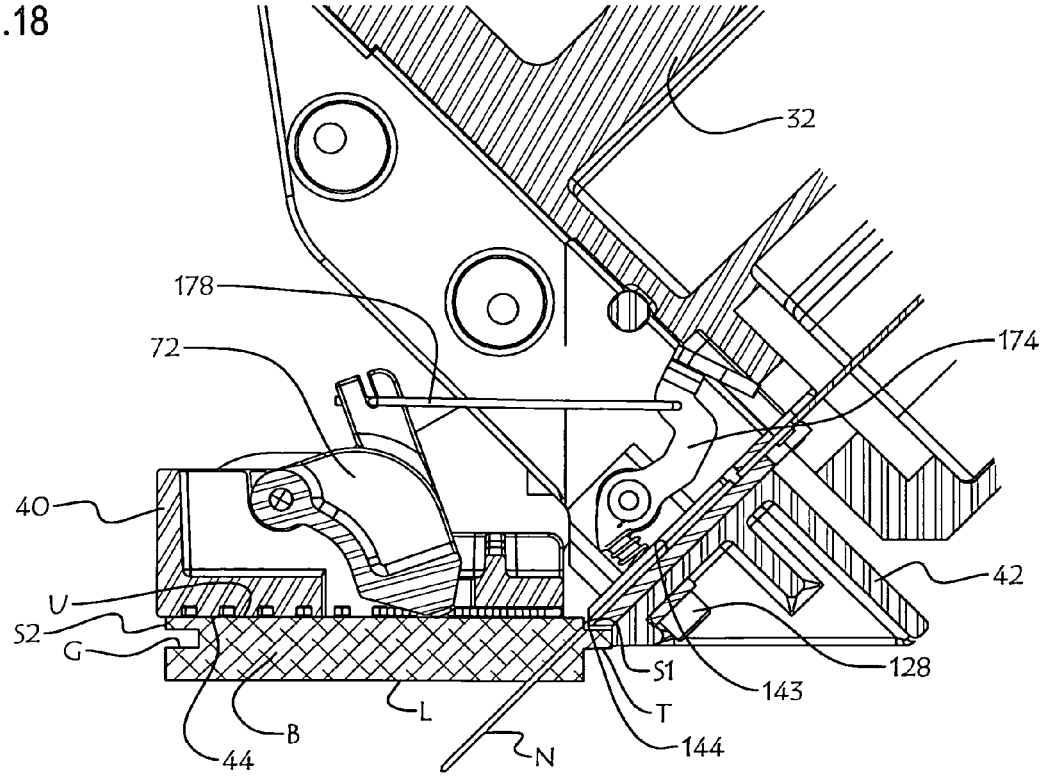
FIG. 18 is similar to FIG. 17 and further shows a board operatively engaged by the nailer and a nail driven through the board, with the trigger is in its second position and the blocking arm is in its extracted position.

In use, nailer 30 is destined to drive a nail N through an elongated wooden board B as shown in FIG. 18. Board B conventionally comprises an exposed upper surface U, a lower surface L resting on the sub-floor (not shown), a first side edge S1 that comprises an elongated tongue T running lengthwisely there along, and a second side edge S2 that comprises an elongated groove G running lengthwisely there along. The tongue T of first side edge S1 is shaped and configured to engage the groove G of an adjacent board (not shown), and thus by sequentially edgewisely fitting a number of boards B a hardwood flooring is formed. Nail N is to be inserted through the board first side edge S1, diagonally through the upper junction of tongue T and the side edge wall. By inserting nail N in this manner, board B will be fixed to the sub-floor, while nail N will be invisible from atop the hardwood flooring once another board B is installed adjacent the illustrated board with its second side edge fitted against the illustrated board's first side edge S1. It is noted that, normally, a number of nails are inserted along a same side edge to fix a given board to the sub-floor.

To insert nail N properly, nailer 30 must consequently first be properly positioned. For the user of nailer 30, this means positioning nail outlet 144 of nail ejection channel 143 adjacent to the upper junction between the board first side edge S1 and tongue T; and correctly aligning nail ejection channel 143 so that nail N will be ejected diagonally downwardly into board B. To help in this undertaking, nailer 30 is provided with a pair of guide members in the form of sole 40 and abutment block 42 that are both carried by and movable relative to the nailer main body 32. Sole bearing surface 44 is destined to rest against the board upper exposed surface U, while abutment block bearing surface 124 is destined to rest against tongue T of first side edge S1. Generally, it can be said that the board upper exposed surface U and the board side edge tongue T are two reference surfaces both located outboard of nailer 30 and used to position the nail ejection channel 143 properly relative to the board. Where prior art nailers were required to be used with boards of appropriate shapes so that the guide members would allow the nail ejection channel to be automatically properly positioned relative to the board, the nailer 30 of the present invention allows the position of nail ejection channel 143 to be adjusted by means of the above-mentioned sole and abutment block adjuster mechanisms.

Figure 17:
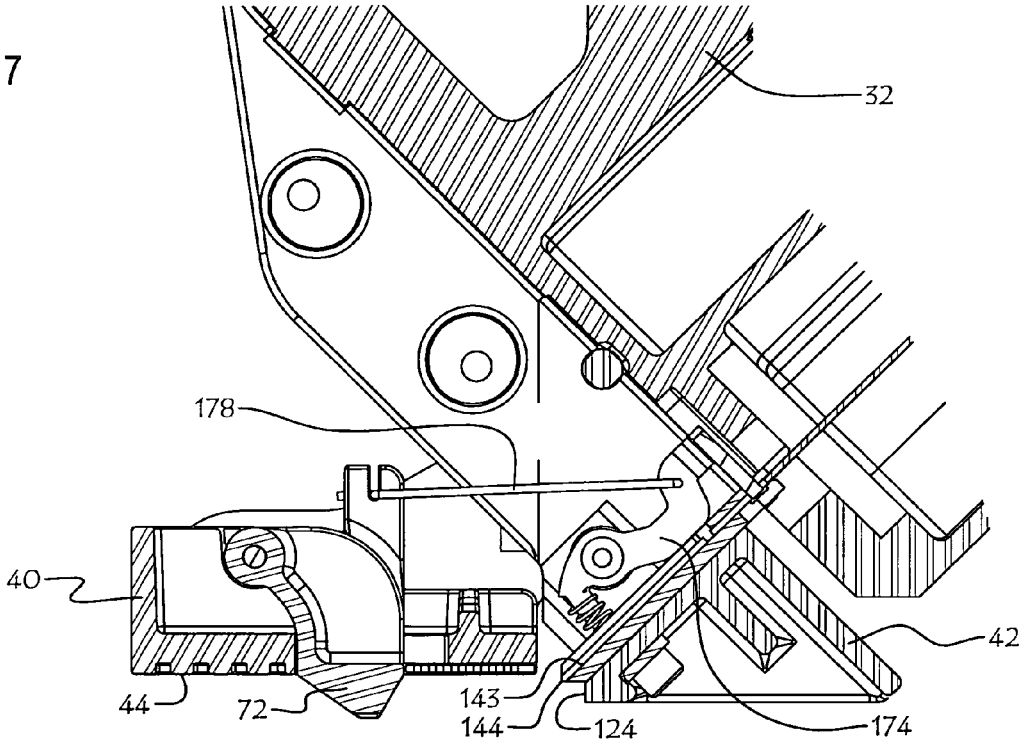
FIG. 17 is a partial cross-sectional side elevation, at an enlarged scale, of the nailer of FIG. 1, with the trigger in its first position and with the blocking arm in its inserted position.

More specifically, when nailer 30 is to be used to drive a nail in board B, it is initially in a condition similar to the one shown in FIG. 17, with trigger 72 extending downwardly beyond sole bearing surface 44. Upon nailer 30 engaging board B as shown in FIG. 18, the position of nailer 30 can be adjusted so that sole bearing surface 44 and abutment block bearing surface 124 will respectively abut against the board upper exposed surface U and the board tongue T to help position nail ejection channel 143 relative to board B. More specifically, the nail outlet 144 of nail ejection channel 143 will be positioned near the junction between board side edge S1 and tongue T by means of the abutment of abutment block bearing surface 124 on tongue T, while nail ejection channel 143 will have a proper orientation due to sole bearing surface 44 flatly resting on the board upper exposed surface U.

As sole 40 engages the board upper exposed surface U as shown in FIGS. 15, 16 and 18, the free end of trigger 72 will also engage the board upper exposed surface U, forcing trigger 72 to pivot from its first to its second positions and concurrently forcing plunger blocking arm 174 to move from its inserted to its retracted position against the bias of spring 180, thus allowing nailer 30 to eject nails. It is noted that the use of nail blocking arm 174 consequently represents a security mechanism that helps prevent accidental undesired ejection of nails when nailer 30 is not positioned atop a surface to be nailed.

Figure 19:
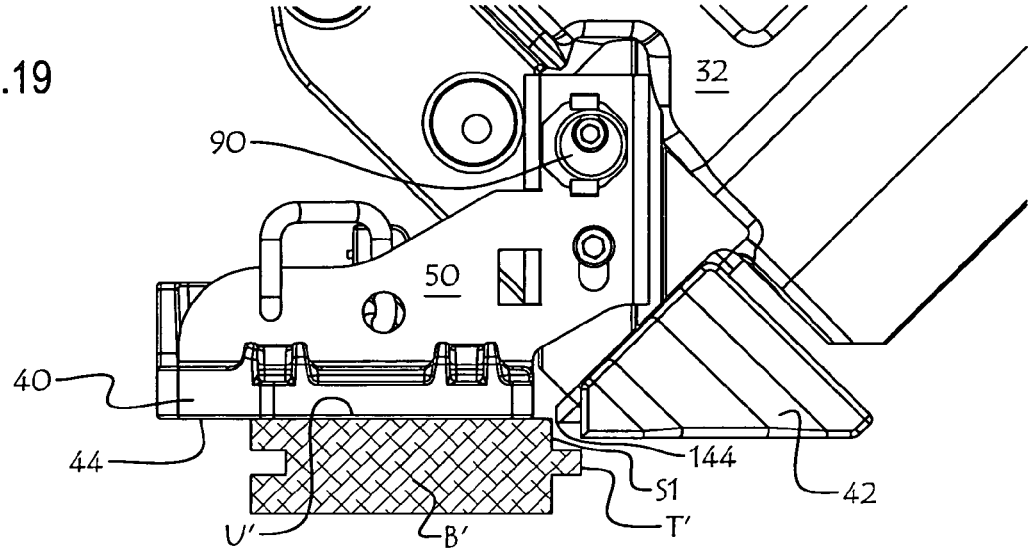
FIGS. 19 and 20 are partial side elevations, at an enlarged scale, of the nailer of FIG. 1 resting atop a board having a different configuration than the board of FIG. 18, and sequentially suggesting the adjustment of the relative position of the sole and the main body of the nailer to accommodate this different board configuration.
Figure 20:
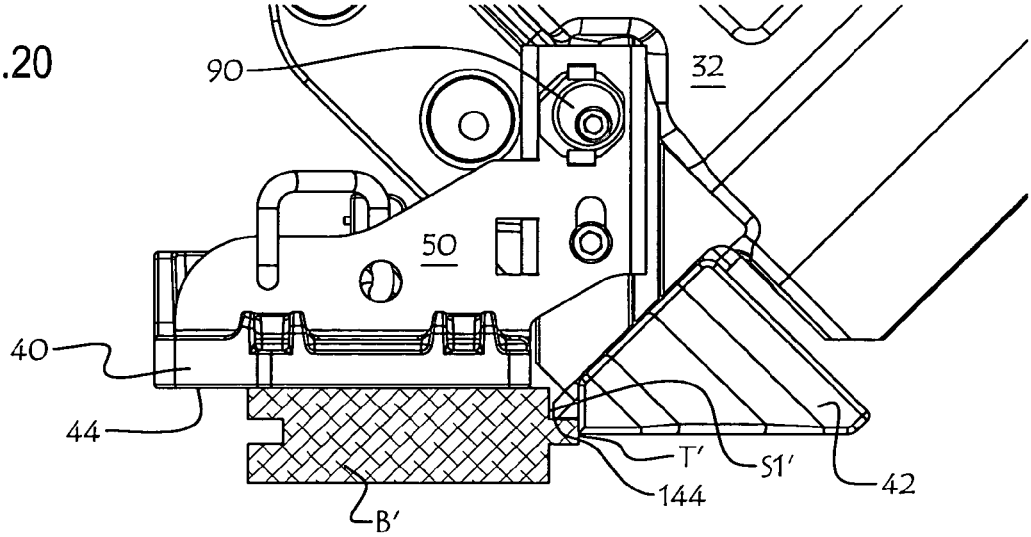

It is known that boards B may have varying configurations, although most have the same general features. FIGS. 19-20 show a board B' that is slightly different from board B shown in FIGS. 17-18, in that its tongue T' is located farther away from the upper exposed surface U', i.e. it is more centered along side edge S1'. If nailer 30 was to be used with the same configuration as that of FIGS. 17-18, nail outlet 144 would then be positioned as shown in FIG. 19, i.e. nearer the upper extremity of board side edge S1' than tongue T', and consequently away from the target junction between tongue T' and side edge S1'. However, by adjusting the relative position of main body 32 and sole 40, it becomes possible to lower nail outlet 144 as shown in FIG. 20 to align it with the target junction between tongue T' and side edge S1'. This is accomplished by rotating cams 88, 90 as described hereinabove, which results in a vertical displacement of main body 32 relative to sole 40. It can be seen in FIGS. 19 and 20 by the position of the bolt holding cam 90 to rod 96, that cam 90 (and consequently cam 88) has been rotated of approximately 180° between FIGS. 19 and 20. In the illustrated embodiment of the invention, this is the maximum angular displacement allowed for cams 88, 90, but alternate embodiments could be envisioned where the cam member has a greater range of angular displacement.

Figure 21:
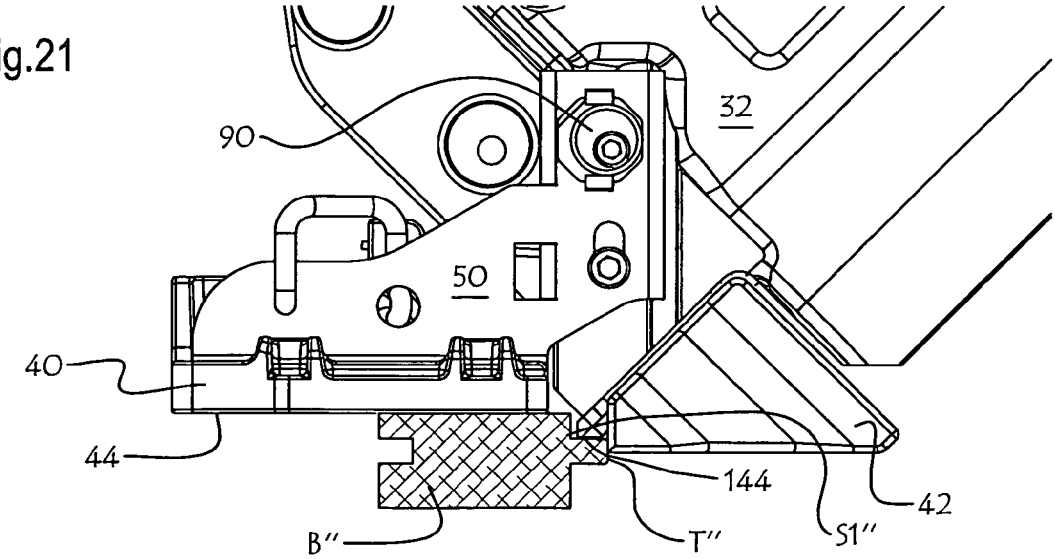
FIG. 21 is similar to FIG. 20, although the board has yet another different configuration and the nailer abutment block is positioned differently to accommodate this other board configuration.

FIG. 21 shows yet another board B" which differs from board B' of FIGS. 19-20 in that its tongue T" is slightly longer than that of board B' of FIGS. 19-20. In such a case, both guide members can be adjusted to accommodate the different board B" configuration: sole 40 can be lowered as detailed hereinabove, while abutment block 42 can be displaced along its inclined adjoining surface with main body 32 away from board B" to accommodate the longer tongue T". This displacement of abutment block 42 is accomplished by first loosening set screws 126, 128, then manually sliding abutment block 42 to a desired position, and afterwards tightening set screws 126, 128 once again to set the position of abutment block 42.

It is understood that, in most circumstances, the relative positions of sole 40 and abutment block 42 need only be adjusted once for an entire construction site where the floor boards will usually have a same configuration. However, when nailer 30 is used in different constructions sites having differing floor board configurations, then the guide members may be adjusted accordingly to accommodate these differing board configurations.

It is noted that nailer 30 could be used to nail other elements than floor boards. Generally, the present invention allows the nailer guide members to be adjusted by means of their respective adjuster mechanisms, wherein upon nailer 30 being applied against first and second reference surfaces, the first and second guide members will respectively engage or abut against these first and second reference surfaces to help position the nail ejection channel 143 of nailer 30 relative to the first and second reference surfaces. The first and second references surface may be the floor board upper exposed surface U or side edge tongue T, or alternately other reference surfaces.

It is also noted that although the nailer 30 of the present invention is intended to be provided with two guide members, it is also envisioned in one embodiment of the present invention that the nailer be provided with a single one of the two above-described guide members and its corresponding adjuster mechanism. In such an embodiment, another fixed guide member could also be provided.

Also, as can be seen in the embodiment of the invention shown in the drawings, for example in FIGS. 17-21, the translational displacement of main body 32 relative to sole 40 is accomplished in a translational direction which intersects the ejection axis of the nail ejection channel 143. In this embodiment, this translational direction and the ejection axis are angularly spaced apart of in between 40° to 55°. Furthermore, the translational displacement of main body 32 relative to sole 40 is accomplished in a translational direction which is transversal to the sole bearing surface 44, and more particularly perpendicular thereto; and which is further transversal to the direction of the translational displacement of abutment block 42 relative to main body 32. Indeed, the direction of the translational displacement of abutment block 42 relative to main body 32 is parallel to the nail ejection axis. The abutment block bearing surface 124 is perpendicular to the sole bearing surface 44. It is noted, however, that all the above-mentioned directions represent but one embodiment of the invention, and that alternate configurations could be envisioned as will be obvious to someone skilled in the art of the present invention.

Another feature of the specific embodiment of the invention shown in the drawings is that nail outlet 144 is located between sole 40 and abutment block 42 at the main body lower end 32*b*. However, it is understood that the nail outlet could be positioned differently relative to the two guide members.

It is noted that some references to the horizontal and vertical directions are made within the present specification. Such directions are referred to considering that nailer 30 is in an upright position, i.e. with its vertical axis being vertical. However, the nailer may be used in other positions.

We claim:

1. A nailer comprising:

a main body;

an elongated nail ejection channel in said main body for receiving a nail to be ejected and including a nail outlet leading out of said main body;

a plunger carried within and movable along said nail ejection channel;

an actuator capable of moving said plunger along an ejection axis in said nail ejection channel for selectively ejecting the nail out through said nail outlet;

a first guide member carried by and movable relative to said main body, for engaging a first reference surface outboard of said nailer; and a first adjuster mechanism capable of adjusting the position of said first guide member relative to said main body;

wherein the position of said nail ejection channel can be adjusted relative to the first reference surface with said first adjuster mechanism when said nailer engages the first reference surface with said first guide member;

said main body defining opposite upper and lower ends with said nail outlet being located at said lower end, said first guide member comprising a sole carried by said main body at said lower end thereof, said sole defining a substantially flat sole bearing surface oriented away from said main body for resting on the first reference surface and a sole attachment surface opposite said sole bearing surface, with said sole attachment surface movably attached to said main body;

wherein said first adjuster mechanism comprises a first lug and track member attached to said main body and a corresponding second lug and track member attached to said sole and operative on said sole attachment surface thereof, said first and second lug and track members being complementary and slidably interconnected and thus allowing a translational displacement of said main body relative to said sole, said first adjuster mechanism further comprising a control member to control the position of said sole relative to said main body.

2. A nailer as defined in claim 1, wherein said translational displacement of said main body relative to said sole is accomplished in a translational direction which intersects said ejection axis.

3. A nailer as defined in claim 2, wherein said translational direction and said ejection axis are angularly spaced apart by a value ranging between 40° and 55°.

4. A nailer as defined in claim 1, wherein said control member comprises a cam member rotatably mounted to said second lug and track member, and a rod eccentrically engaging said cam member and said first lug and track member, whereby rotation of said cam member will impart said translational displacement of said main body relative to said sole.

5. A nailer as defined in claim 4, wherein said control member further comprises a setting member for releasably setting the relative position of said main body and said sole once this relative position has been adjusted with said cam member.

6. A nailer as defined in claim 1, wherein said sole is releasably movably attached to said main body.

7. A nailer as defined in claim 1, wherein said sole is releasably attached to said second lug and track member.

8. A nailer as defined in claim 1, wherein said main body defines opposite upper and lower ends and a longitudinal axis there between, with said ejection channel being located at said lower end, said first guide member comprising an abutment block carried by said main body at said lower end thereof, said abutment block defining an abutment block attachment surface movably attached to said main body and an abutment block bearing surface which is parallel to said longitudinal axis, said abutment block bearing surface for abutting on the first reference surface.

9. A nailer as defined in claim 1, further comprising:

a second guide member carried by and movable relative to said main body, for engaging a second reference surface outboard of said nailer; and a second adjuster mechanism capable of adjusting the position of said second guide member relative to said main body;

wherein the position of said nail ejection channel can be adjusted relative to the second reference surface with said second adjuster mechanism when said nailer engages the second reference surface with said second guide member.

10. A nailer as defined in claim 9, wherein said main body defines opposite upper and lower ends and a longitudinal axis therebetween, with said nail outlet being located at said lower end, said first guide member comprising a sole carried by said main body at said lower end thereof, said sole defining a substantially flat sole bearing surface oriented away from said main body for resting on the first reference surface and a sole attachment surface opposite said sole bearing surface, with said sole attachment surface movably attached to said main body, said second guide member comprising an abutment block carried by said main body at said lower end thereof, said abutment block defining an abutment block attachment surface movably attached to said main body and an abutment block bearing surface which is parallel to said longitudinal axis, said abutment block bearing surface for abutting on the second reference surface.

11. A nailer as defined in claim 10, wherein said nail outlet is located between said sole and said abutment block at said main body lower end.

12. A nailer as defined in claim 10, wherein said abutment block bearing surface is perpendicular to said sole bearing surface.

13. A nailer as defined in claim 10, wherein said first adjuster mechanism comprises a first lug and track member attached to said main body and a corresponding second lug and truck member attached to said sole and operative on said attachment surface thereof, said first and second lug and back members being complementary and slidably interconnected and thus allowing translational displacement of said main body relative to said sole in a first translational direction, said first adjuster mechanism further comprising a control member to control the position of said sole relative to said main body, and wherein said second adjuster mechanism comprises a first elongated slot and pin member provided on said abutment block and operative on said attachment surface thereof and a corresponding second elongated slot and pin member provided on said main body, said first and second elongated slot and pin members being complementary and slidably interconnected and thus allowing translational displacement of said main body relative to said abutment block in a second translational direction.

14. A nailer as defined in claim 13, wherein said first and second translational directions are transversal to each other.

15. A nailer as defined in claim 14, wherein said first translational direction is parallel to said longitudinal axis and perpendicular to said sole bearing surface, and said second translational direction is transversal to said longitudinal axis and to said abutment block bearing surface and parallel to said ejection axis.

16. A nailer as defined in claim 1, further comprising a security plunger blocking member selectively releasably engageable in said nail ejection channel to thus selectively prevent the movement of said plunger in said nail ejection channel for preventing accidental ejection of the nail out of said nail outlet.

17. A nailer comprising:

a main body;

an elongated nail ejection channel in said main body for receiving a nail to be ejected and including a nail outlet leading out of said main body;

a plunger carried within and movable along said nail ejection channel;

an actuator capable of moving said plunger along an ejection axis in said nail ejection channel for selectively ejecting the nail out through said nail outlet;

a first guide member carried by and movable relative to said main body, for engaging a first reference surface outboard of said nailer; and a first adjuster mechanism capable of adjusting the position of said first guide member relative to said main body;

wherein said first adjuster mechanism comprises a first elongated slot and pin member provided on said abutment block and operative on said attachment surface thereof and a corresponding second elongated slot and pin member provided on said main body, said interconnected and thus allowing translational displacement of said main body relative to said abutment block;

and wherein the position of said nail ejection channel can be adjusted relative to the first reference surface with said first adjuster mechanism when said nailer engages the first reference surface with said first guide member;

said main body defining opposite upper and lower ends with a longitudinal axis therebetween, with said ejection channel being located at said main body lower end, said first guide member comprising an abutment block carried by said main body at said lower end thereof, said abutment block defining an abutment block attachment surface movably attached to said main body and an abutment block bearing surface which is parallel to said longitudinal axis, said block bearing surface for abutting on the first reference surface.

18. A nailer as defined in claim 17, wherein said abutment block bearing surface is transversal to said sole bearing surface.

19. A nailer as defined in claim 17, wherein said translational displacement of said main body relative to said abutment block is accomplished in a translational direction which is parallel to said nail ejection axis and transversal to said abutment block bearing surface.

20. A nailer as defined in claim 19, wherein said first adjuster means further comprises a setting member for releasably setting the relative position of said main body and said abutment block once this relative position has been adjusted.

21. A nailer as defined in claim 20, wherein said setting member comprises at least one set screw which is part of one of said first and second elongated slot and pin members and capable of releasably setting the relative position of said main body and said abutment block.

22. A nailer comprising;

a main body;

an elongate nail ejection channel in said main body for receiving a nail to be ejected and including a nail outlet leading out of said main body;

a plunger carried within and movable along said nail ejection channel;

an actuator capable of moving said plunger along an ejection axis in said nail ejection channel for selectively ejecting the nail out through said nail outlet;

a first guide member carried by and movable relative to said main body, for engaging a first reference surface outboard of said nailer; and a first adjuster mechanism capable of adjusting the position of said first guide member relative to said main body; and a security plunger blocking member selectively releasably engageable in said nail ejection channel to thus selectively prevent the movement of said plunger in said nail ejection channel for preventing accidental ejection of the nail out of said nail outlet;

wherein the position of said nail ejection channel can be adjusted relative to the first reference surface with said first adjuster mechanism when said nailer engages the first reference surface with said first guide member;

wherein said security plunger blocking member comprises:

a blocking arm pivotally carried by said main body and pivotable between an inserted position in which said blocking arm engages said nail ejection channel and a retracted position in which said blocking arm clears said nail ejection channel;

a biasing member continuously biasing said blocking arm towards said inserted position; and a blocking arm trigger carried by said main body and movable between a first position in which it extends beyond said first guide member relative to said main body and in which said blocking arm is allowed to remain in said inserted position through the action of said biasing member, and a second position in which said trigger forces said blocking arm into said retracted position against the bias of said biasing member;

wherein upon said nailer being applied against the first reference surface with said first guide member abutting against the first reference surface, said trigger will be moved from said first to said second position for concurrently forcing said blocking arm from said inserted to said retracted position, thus allowing a nail to be ejected from said nail ejection channel.

23. A nailer as defined in claim 22, wherein said main body defines opposite upper and lower ends with said nail outlet being located at said lower end, said first guide member comprising a sole carried by said main body at said lower end thereof, said sole defining a substantially flat sole bearing surface oriented away from said main body for resting on the first reference surface and a sole attachment surface opposite said sole bearing surface, with said sole attachment surface movably attached to said main body.

* * * * *